US012173956B2

(12) United States Patent
Lee et al.

(10) Patent No.: US 12,173,956 B2
(45) Date of Patent: Dec. 24, 2024

(54) REFRIGERATOR AND HOME APPLIANCES

(71) Applicant: LG Electronics Inc., Seoul (KR)

(72) Inventors: Jong Hwa Lee, Seoul (KR); O Min Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 84 days.

(21) Appl. No.: 18/081,381

(22) Filed: Dec. 14, 2022

(65) Prior Publication Data

US 2023/0213268 A1 Jul. 6, 2023

(30) Foreign Application Priority Data

Jan. 4, 2022 (KR) ..... 10-2022-0000726
Apr. 20, 2022 (KR) ..... 10-2022-0049181

(51) Int. Cl.
*F25D 23/02* (2006.01)
*F25D 23/06* (2006.01)

(52) U.S. Cl.
CPC ..... *F25D 23/028* (2013.01); *F25D 23/067* (2013.01); *F25D 2201/126* (2013.01)

(58) Field of Classification Search
None
See application file for complete search history.

(56) References Cited

U.S. PATENT DOCUMENTS 10,285,513 B2 * 5/2019 Lee ..... F25D 27/00
10,701,770 B2 * 6/2020 Jang ..... H05B 6/6414
2017/0234609 A1 * 8/2017 Park ..... F25D 29/005 345/174
2019/0257571 A1 * 8/2019 Park ..... E06B 3/70
2021/0318057 A1 10/2021 Park et al.

FOREIGN PATENT DOCUMENTS

| | | | | |
|---|---|---|---|---|
| CN | 204202289 U | * | 3/2015 | ..... F25D 23/02 |
| JP | 6460832 | | 1/2019 | |
| KR | 10-2006-0114584 | | 11/2006 | |
| KR | 20150110018 A | * | 10/2015 | |
| KR | 10-2018-0024352 | | 3/2018 | |
| KR | 10-2018-0067391 | | 6/2018 | |
| KR | 10-2020-0066812 | | 6/2020 | |
| KR | 10-2021-0022515 | | 3/2021 | |
| KR | 10-2275154 | | 7/2021 | |

OTHER PUBLICATIONS

Office Action in Korean Appln. No. 10-2022-0000726, mailed on Nov. 28, 2023, 14 pages (with English translation).
Extended European Search Report in European Appln. No. 22216983.1, mailed on May 8, 2023, 10 pages.

* cited by examiner

*Primary Examiner* — Hanh V Tran
(74) *Attorney, Agent, or Firm* — Fish & Richardson P.C.

(57) ABSTRACT

A refrigerator includes: a door including a door body and a door panel coupled to the door body, and a buffer member disposed at a rear surface of the door panel and provided between the door body and the door panel. The door body defines a first part at a front surface, an adhesive portion is provided at the first part between the door body and the door panel to thereby couple a rear surface of the door panel to the front surface of the door body, and the buffer member contacts a first portion of the adhesive portion and the rear surface of the door panel contacts a second portion of the adhesive portion.

20 Claims, 24 Drawing Sheets

(d)

(e)

REFRIGERATOR AND HOME APPLIANCES

CROSS-REFERENCE TO RELATED APPLICATIONS

This application claims the benefit of priority of Korean Patent Application No. 10-2022-0000726, filed on Jan. 4, 2022 and Korean Patent Application No. 10-2022-0049181, filed on Apr. 20, 2022. The disclosures of the prior applications are incorporated by reference in their entirety.

TECHNICAL FIELD

The present disclosure relates to a refrigerator and home appliances.

BACKGROUND

In general, a refrigerator includes a cabinet provided with a storage space, a door for shielding the cabinet and a device for performing refrigeration cycle to supply cold air to the storage space and is configured to optimally store food stored in the storage space.

In such a refrigerator, structures in which the outer appearance of the front surface of a door of the refrigerator is varied in order to harmonize with surrounding furniture or home appliances have been developed. This phenomenon is the same for general home appliances.

A conventional structure includes a panel that defines an outer appearance and that is mounted on the front surface of a door.

However, in such a conventional structure, it is not easy to attach and detach the glass panel, and thus there is a problem in that it is difficult to change the outer appearance of the front surface of the door.

In addition, there is a problem that a gap occurs between the glass panel and the door body, and thus the completeness of the outer appearance is deteriorated.

In addition, there is a problem in that the components constituting the door cannot be shared by changing the structure of the portion on which the panel is mounted, according to the material or type of the panel.

In addition, when the panel is made of a metal material, there is a problem in that the panel is bent due to an impact due to the insulation filling or an external impact, and thus the outer appearance is deformed.

SUMMARY

The present disclosure is directed to a refrigerator and home appliances with improved assembling operability of a door panel forming an outer appearance of a door.

The present disclosure is also directed to a refrigerator and home appliances with improved door aesthetics, rigidity, and durability.

The present disclosure is also directed to a refrigerator and home appliances that can block an outer appearance of a panel providing a front surface of a door from being deformed by an impact caused by foaming for forming an insulation material, external impact, or the like.

The present disclosure is also directed to a refrigerator and home appliances in which the types of necessary components can be reduced and costs can be saved by enabling the assembly of the door panel and the door body regardless of the material and type of the door panel.

According to one aspect of the subject matter described in this application, a refrigerator can include a door including a door body and a door panel coupled to the door body, and a buffer member disposed at a rear surface of the door panel and provided between the door body and the door panel. The door body can define a first part at a front surface, an adhesive portion can be provided at the first part between the door body and the door panel to thereby couple a rear surface of the door panel to the front surface of the door body, and the buffer member can contact a first portion of the adhesive portion and the rear surface of the door panel can contact a second portion of the adhesive portion.

Implementations according to this aspect can include one or more of the following features. For example, the door panel and the adhesive portion can be configured to, based on the door body being coupled to the door panel, change a form of the buffer member.

In some implementations, the buffer member can overlap a portion of the first part and can be configured to, based on the door body being coupled to the door panel, block the door panel from being bent. In some examples, the buffer member can be spaced apart from an end portion of the door panel at a predetermined distance.

In some implementations, the buffer member can overlap a portion of the first part that is less than a portion of the first part overlaps with the adhesive portion. In some examples, the adhesive portion can overlap an entire surface of the first part of the door body.

In some implementations, the buffer member can overlap with a portion of the adhesive portion to cause the door panel to form an insulation material. In some examples, the buffer member can overlap with 10 to 50% of the adhesive portion.

In some implementations, the door body can include a second part connected to the first part. In some examples, a distance between the door panel and the second part can be greater than a distance between the door panel and the first part. In some examples, a distance between a front edge of the door body and the second part can be greater than a distance between the front edge of the door body and the first part.

In some implementations, the refrigerator can further include a foam provided between the door body and the door panel. The door panel can provide a bent portion at a first end, the bent portion spaced apart from the second part. In some examples, the foam can be provided between the bent portion and the second part.

In some examples, the bent portion can be bent inwardly to thereby contact the foam. In some examples, an end portion of the bent portion can be substantially parallel to the second part. In some examples, the end portion of the bent portion and the second part can be spaced apart at a predetermined distance.

According to another aspect of the subject matter described in this application, a home appliance can include a door including a door body and a door panel coupled to the door body, and a buffer member disposed at a rear surface of the door panel and provided between the door body and the door panel. The door body can define a first part at a front surface, an adhesive portion can be provided at the first part between the door body and the door panel to thereby couple a rear surface of the door panel to the front surface of the door body, and the buffer member can contact a first portion of the adhesive portion and the rear surface of the door panel can contact a second portion of the adhesive portion.

Implementations according to this aspect can include one or more of the following features. For example, the door panel and the adhesive portion can be configured to, based on the door body being coupled to the door panel, change a form of the buffer member.

In some implementations, the buffer member can overlap a portion of the first part and can be configured to, based on the door body being coupled to the door panel, block the door panel from being bent. In some examples, the buffer member can overlap a portion of the first part that is less than a portion of the first part overlaps with the adhesive portion, and the adhesive portion can overlap an entire surface of the first part of the door body.

The door panel can be configured to be detachably attached to the door body, so that the outer appearance of the front surface of the door can be easily changed by replacing the door panel.

By minimizing the gap between the door panel and the door body, the completeness of the outer appearance can be improved.

There may be an advantage in that the outer appearance of the panel providing the front surface of the door can be blocked from being changed due to an external impact or an impact when foaming for forming an insulation material.

Regardless of the material and type of the door panel, there may be an advantage that the type of necessary components can be reduced and cost can be saved by unifying the side decor structure coupled with the door panel.

DETAILED DESCRIPTION

Figure 1:
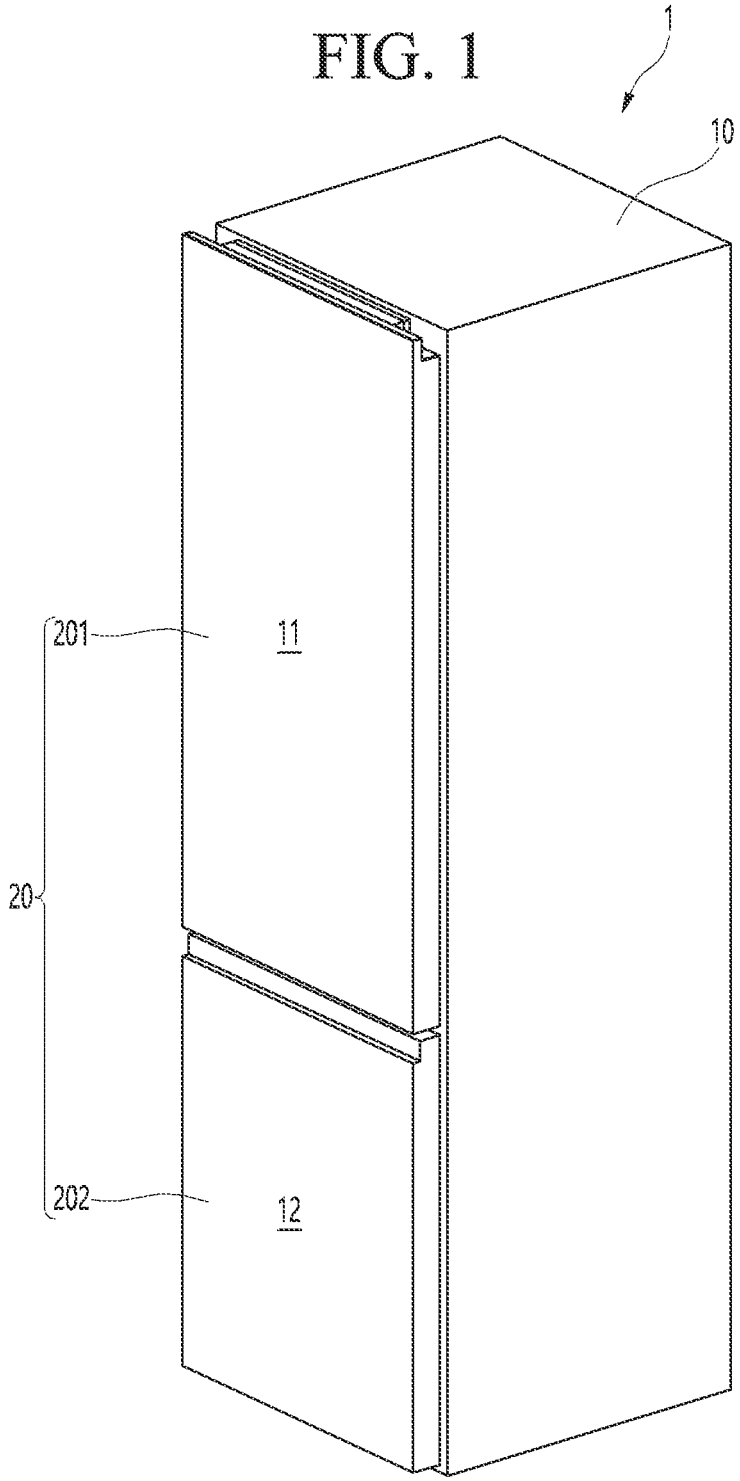
FIG. 1 is a diagram illustrating an example of a refrigerator.

FIG. 1 is a diagram illustrating an example of a refrigerator.

The refrigerator can include a cabinet 10 providing a storage space, and a door disposed in front of the opened cabinet to open and close the storage space.

The storage space can be divided into a plurality of spaces as needed. For example, the storage space of the refrigerator 1 can be divided in the vertical direction and can include an upper storage space 11 and a lower storage space 12. In some implementations, a refrigerating chamber can be provided in the upper storage space 11, and a freezing chamber can be provided in the lower storage space 12.

The door 20 can include an upper door 201 and a lower door 202 that are configured to open and close the upper storage space 11 and the lower storage space 12. The upper door 201 and the lower door 202 can be configured to open and close the storage spaces 11 and 12 by rotation, respectively.

In some implementations, a refrigerator in which the doors 20 are provided singly at the front upper and lower portions of the cabinet, respectively, is described for convenience of explanation and understanding, but the present disclosure is not limited thereto. For example, the upper door 201 and the lower door 202 are provided as a pair, respectively, or can be applied to all types of refrigerators, such as being opened and closed by drawing in and out of drawers.

The front surface of the door 20 can be defined by the panel 30. In some implementations, the panel 30 can define the overall outer appearance of the front surface of the refrigerator.

Hereinafter, the structure of the door 20 will be described in more detail.

Figure 2:
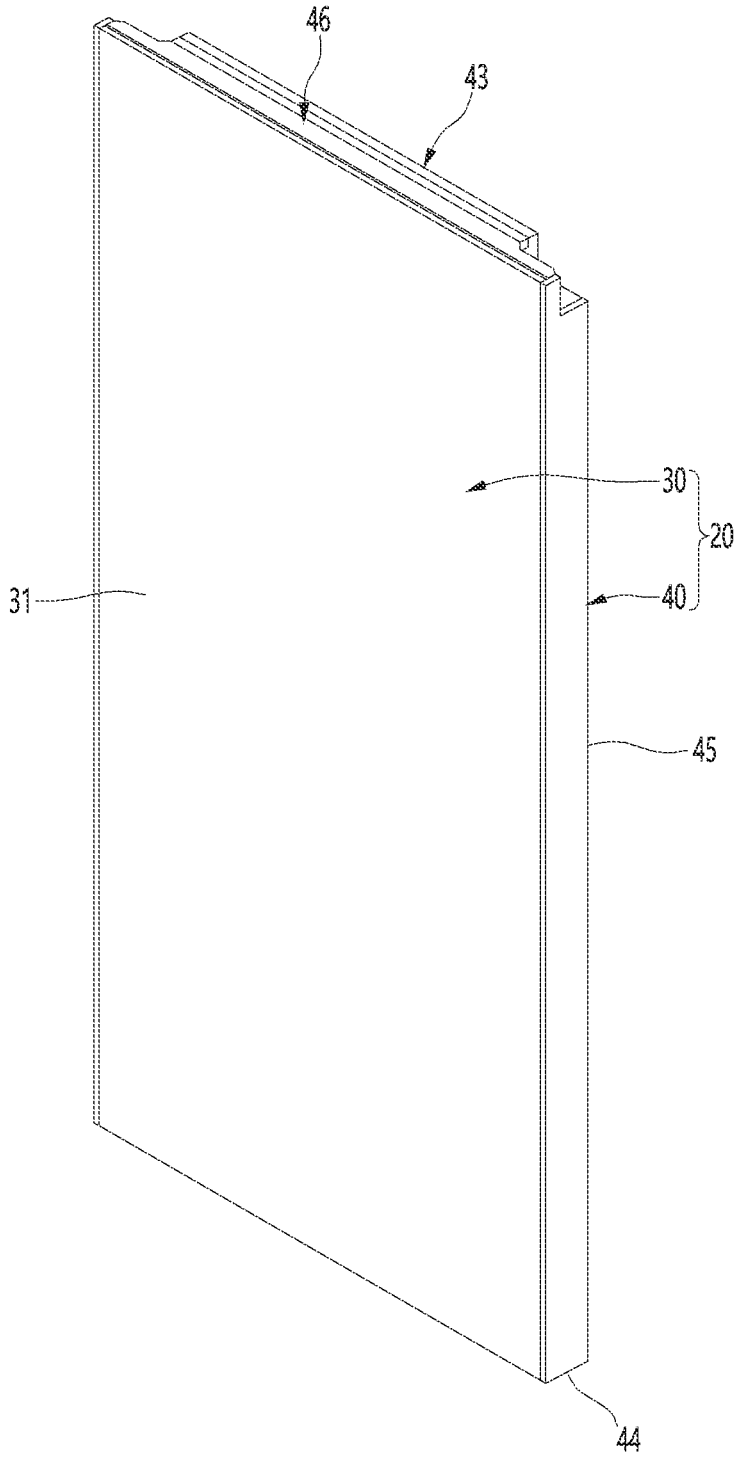
FIG. 2 is a diagram illustrating an example of a state where the door is viewed from the front.
Figure 3:
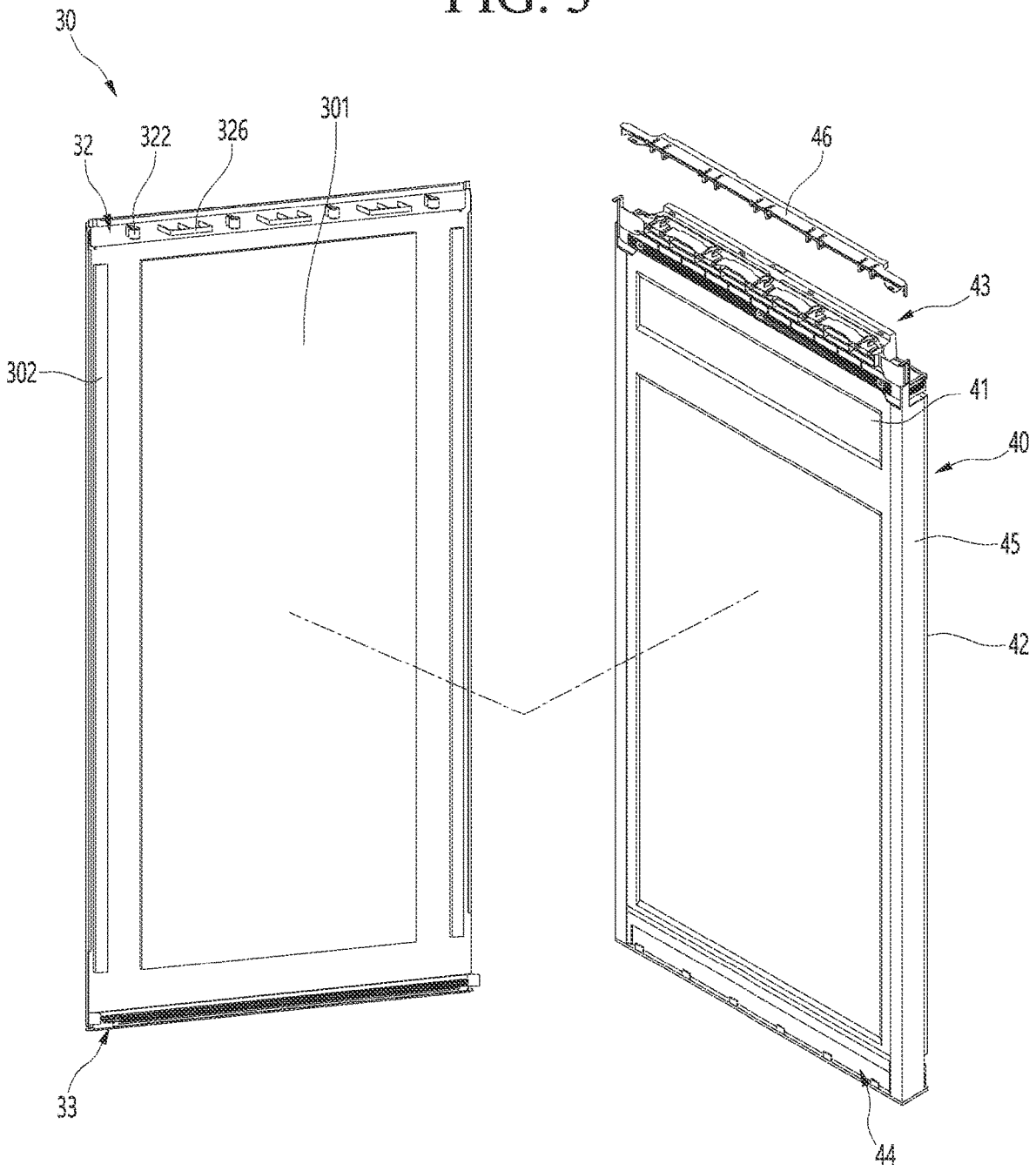
FIG. 3 is a diagram illustrating an example of a state where the door is disassembled into a door body and a door panel.
Figure 4:
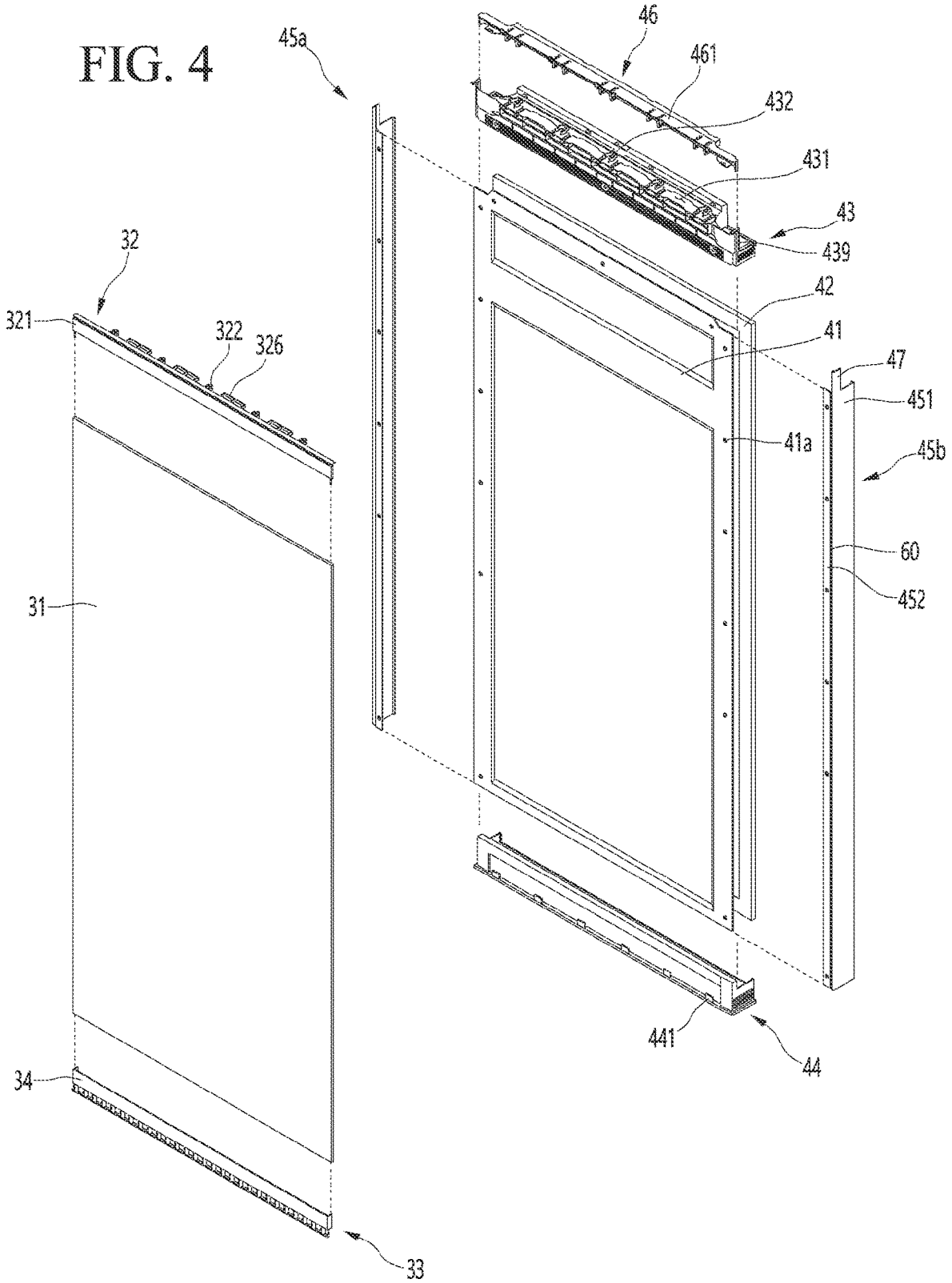
FIG. 4 is a diagram illustrating an exploded perspective view of an exemplary door.

FIG. 2 is a diagram illustrating an example of a state where the door is viewed from the front, FIG. 3 is a diagram illustrating an example of a state where the door is disassembled into a door body and a door panel, and FIG. 4 is a diagram illustrating an exploded perspective view of an exemplary door.

The door 20 can include a door body 40 and a door panel 30 coupled to a front surface of the door body 40.

The door body 40 can provide the overall shape of the door 20. The door body 40 can provide openings for the storage space and can serve as insulation components for the storage space.

The door body 40 can include a body cover 41 providing a front surface and a door liner 42 providing a rear surface. In some implementations, the door body 40 can be provided by coupling the upper cap decor 43 defining the upper surface, the lower cap decor 44 defining the lower surface, and the side decor 45 defining the sides in the left and right direction.

The body cover 41 can provide the front shape of the door body 40. The body cover 41 can have a metal plate shape. A plurality of fastening members 412 can be fastened around the body cover 41 so that the body cover 41 can be more firmly coupled than the upper cap decor 43, the lower cap decor 44, and the side decor 45.

The door liner 42 can provide a rear surface of the door body 40. The door liner 42 can be made of a plastic material. An insulation material 400 can be provided between the body cover 41 and the door body 40.

The upper cap decor 43 can be coupled to the upper end of the body cover 41 and the door liner 42 to provide an upper surface of the door body 40.

In some implementations, the upper cap decor 43 is coupled to the upper bracket 32 so that the door body 40 and the door panel 30 can be coupled.

Decor openings 431 recessed downward can be provided on the upper surface of the upper cap decor 43. Electrical components can be accommodated in the decor opening 431.

The decor opening 431 can be opened toward the upper side of the upper cap decor 43, The opened upper surface of the decor opening 431 can be covered by the decor cover 46.

The decor cover 46 can be mounted on the upper cap decor 43 to provide an upper surface of the door body 40.

The lower cap decor 44 can be coupled to the lower end of the body cover 41 and the door liner 42 to provide a lower surface of the door body 40. The lower cap decor 44 can provide a front lower end of the door body 40. In some implementations, the lower cap decor 44 is coupled to the lower bracket 33 of the door panel 30 so that the door body 40 and the door panel 30 can be coupled.

The side decor 45 can be provided on both sides of the body cover 41 and the door liner 42. The side decor 45 can connect the side ends of the body cover 41 and the door liner 42, the upper cap decor 43 and the lower cap decor 44 in the left and right direction to provide both sides of the door body 40 in the left and right direction.

The side decor 45 can include a bent portion 451 protruding further forward than the body cover 41. The bent portion 451 can support both ends of the door panel 30 in the left and right direction when the door panel 30 is mounted on the door body 40.

The door panel 30 can be mounted on the front surface of the door body 40 to provide a front outer appearance of the door 20. The door panel 30 can correspond to the size of the door body 40. Accordingly, the front surface of the door body 40 can be covered by the door panel 30 and may not be exposed to the outside.

The door panel 30 can have various materials, colors, and designs. The door panel 30 can be provided in a structure that can be easily attached to and detached from the front surface of the door body 40. Accordingly, by replacing the door panel 30, the front material, color, and design of the door 20 can be easily changed.

The door panel 30 can include a front panel 31 that provides the outer appearance of the door front. The front panel 31 can be made of a glass or resin material, or a stainless steel plate material.

The door panel 30 can further include a buffer member 301. The buffer member 301 can be attached to the rear surface of the panel 31 and can be provided between the panel 31 and the body cover 41 when the door panel 30 is mounted on the door body 40. Accordingly, even when an impact or pressure is applied to the front surface of the door panel 30, it is possible to block the door panel 30 from being deformed or damaged. The buffer member 301 can be made of a material having elasticity, such as a sponge, foam PU, or foam PE.

The door panel 30 can further include a magnet 302. The magnet 302 can be attached to the rear surface of the panel 31. In some implementations, when the door panel 30 is mounted on the door body 40, the magnet 302 can be attached to the body cover 41 by magnetic force. Accordingly, the door panel 30 can be temporarily coupled to the door body 40 by the magnet 302. In some implementations, the door panel 30 can be more firmly mounted on the door body 40 by the magnet 302. The magnet 302 can be elongated vertically and can be disposed between the upper bracket 32 and the lower bracket 33. In some implementations, the magnet 302 can be disposed on both sides of the buffer member 301 in the left and right direction.

In addition or alternatively, the door panel 30 can be attached to the body cover 41 by an adhesive.

In some implementations, the door panel 30 can include a panel bracket configured to be mounted on the door body 40.

The panel bracket can include an upper bracket 32 provided on the front panel 31 and coupled to the upper cap decor 43.

The panel bracket can include a lower bracket 33 provided under the front panel 31 and coupled to the lower cap decor 44.

The panel bracket can include at least one of the upper bracket 32 or the lower bracket 33.

Such a panel bracket can be attached to the rear surface of the front panel 31 through an adhesive or the like.

An upper bracket 32 can be provided at an upper end of the rear surface of the door panel 30. The upper bracket 32 can be disposed in front of the upper cap decor 43 and can be mounted on the upper cap decor 43 when the door panel 30 is mounted.

The upper bracket 32 can include a coupling portion 321 coupled to the rear surface of the door panel 30, and a mounting protrusion 322 coupled to the upper cap decor 43.

An adhesive can be applied to the front surface of the coupling portion 321 or a member for adhesion such as a double-sided tape can be disposed on the front surface of the coupling portion 321, and thus the coupling portion can be adhered to the rear surface of the door panel 30.

The mounting protrusion 322 can be inserted into the protrusion accommodation portion 432 of the upper cap decor 43 so that the door panel 30 can be fixedly mounted to the door body 40.

The upper bracket 32 can further include a reinforcing portion 326.

The reinforcing portion 326 can be provided, for example, in a rectangular plate shape or an open shape. The reinforcing portion 326 can be seated on the support portion 433 of the upper cap decor 43.

In a state where the mounting protrusion 322 is inserted into the protrusion accommodation portion 432, the reinforcing portion 326 can be seated on the support portion 324. In this case, there is an advantage that the upper bracket 32 and the upper cap decor 43 can be maintained in a more firmly coupled state.

In some implementations, the upper cap decor 43 includes a front portion 434 facing the upper bracket 32 and a bottom portion 435 seated in a space between the door body 40 and the door liner 42.

A protrusion accommodation portion 432 in which the mounting protrusion 322 is accommodated can be provided in the front portion 434. The protrusion accommodation portion 432 can have a shape corresponding to the mounting protrusion 322. The protrusion accommodation portion 432 can be inserted into the mounting protrusion 322 from the front.

The lower portion of the protrusion accommodation portion 432 can include a protrusion portion 436 extending forward by a predetermined length from the front portion 434.

The protrusion portion 436 can be recessed downward, and an accommodation groove 437 in which the restraining portion 461 of the decor cover 46 is accommodated can be provided.

In some implementations, the mounting protrusion 322 is inserted into the protrusion accommodation portion 432, so that the upper bracket 32 can be coupled to the upper cap decor 43. In addition or alternatively, the restraining portion 461 of the decor cover 46 can be inserted into the accommodation groove 437, so that the decor cover 46 and the upper cap decor 43 can be coupled.

The upper cap decor 43 can have a fastening hole 438 through which the fastening member passes at the lower front end thereof. The fastening member passing through the fastening hole 438 can be coupled to the upper end portion of the door body 40. Accordingly, the lower end portion of the upper cap decor 43 can be coupled to the upper end portion of the door body 40.

The lower bracket 33 can be provided at the lower end of the door panel 30. The lower bracket 33 can be attached to the lower rear surface of the door panel 30.

A coupling portion 34 coupled to the rear surface of the door panel 30 can be provided on the front surface of the lower bracket 33. In some implementations, a mounting portion 35 protruding rearwardly to be mounted on the lower cap decor 44 is provided in the rear surface of the lower bracket 33. Since the coupling portion 34 and the mounting portion 35 are provided in the lower bracket 33, they may also be referred to as the lower coupling portion 34 and the lower bracket 33, respectively.

The lower coupling portion 34 can have a plate shape to provide a region to be adhered to the rear surface of the door panel 30 by an adhesive. An adhesive or the like can be applied to the front surface of the lower coupling portion 34 to be mounted on the front panel 31.

In some implementations, the rear side of the lower bracket 33 has a structure that can be coupled with the lower cap decor 44.

On the rear side of the lower bracket 33, one surface can have an opening and a lower mounting portion 35 having a chamber 36 into which the restraining portion 441 of the lower cap decor 44 is inserted can be provided.

A plurality of restraining portions 441 protruding upwardly from the lower front end portion of the lower cap decor 44 can be arranged along a direction in which the lower cap decor 44 extends. In a state where the lower bracket 33 is mounted on the door panel 30, the restraining portion 441 can be inserted into the chamber 36 of the lower mounting portion 35 to couple the lower bracket 33 and the lower cap decor 44.

In some implementations, side decors 45 are provided on both sides of the door panel 30 and the door body 40. Hereinafter, the side decor 45 will be described in detail.

Figure 5:
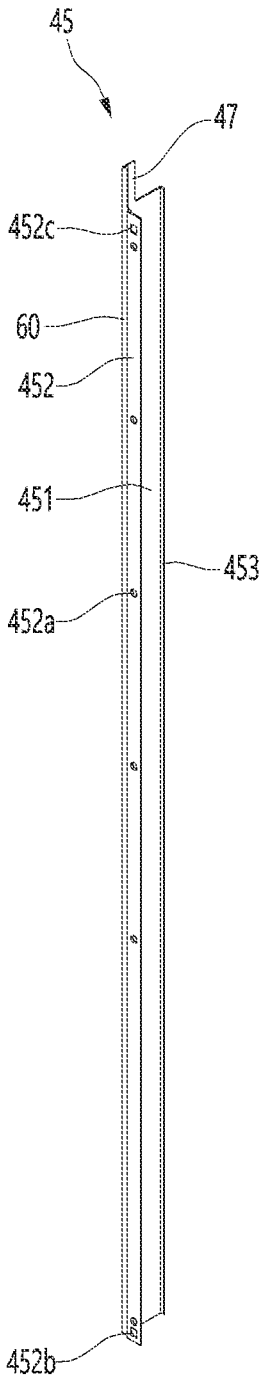
FIG. 5 is a diagram illustrating an example of a state where a side decor is viewed from one side.
Figure 6:
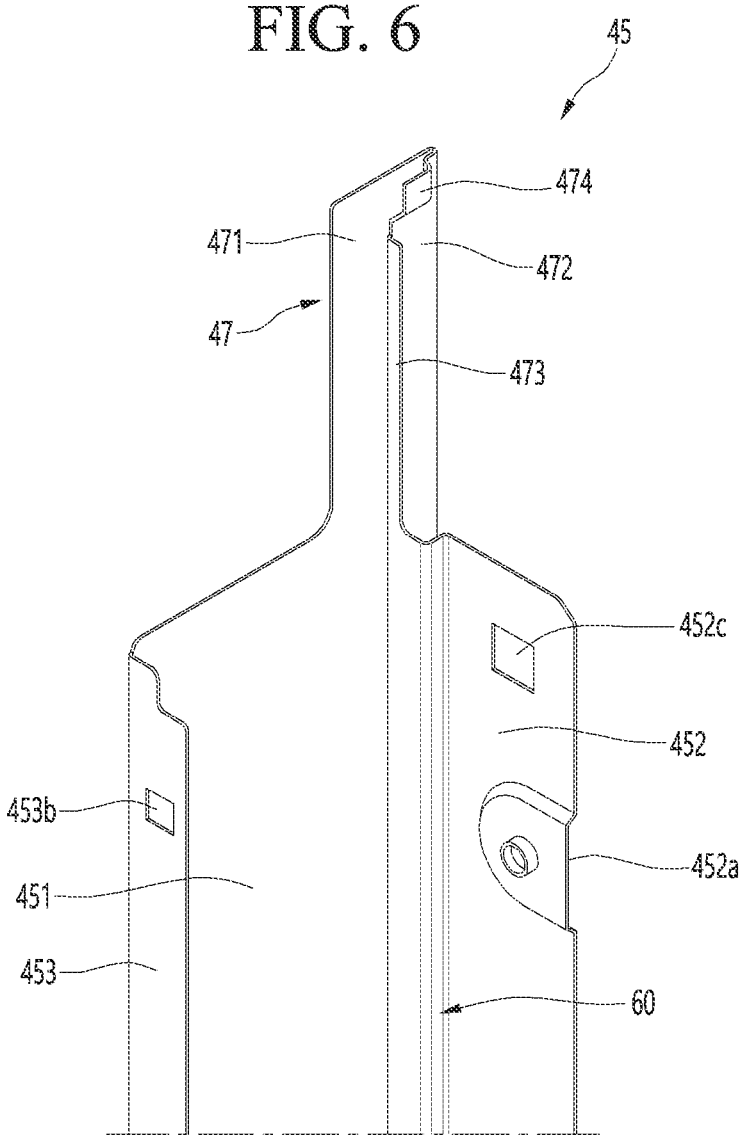
FIG. 6 is a diagram illustrating an example of a state where a portion A of FIG. 5 is viewed from the other side.
Figure 7:
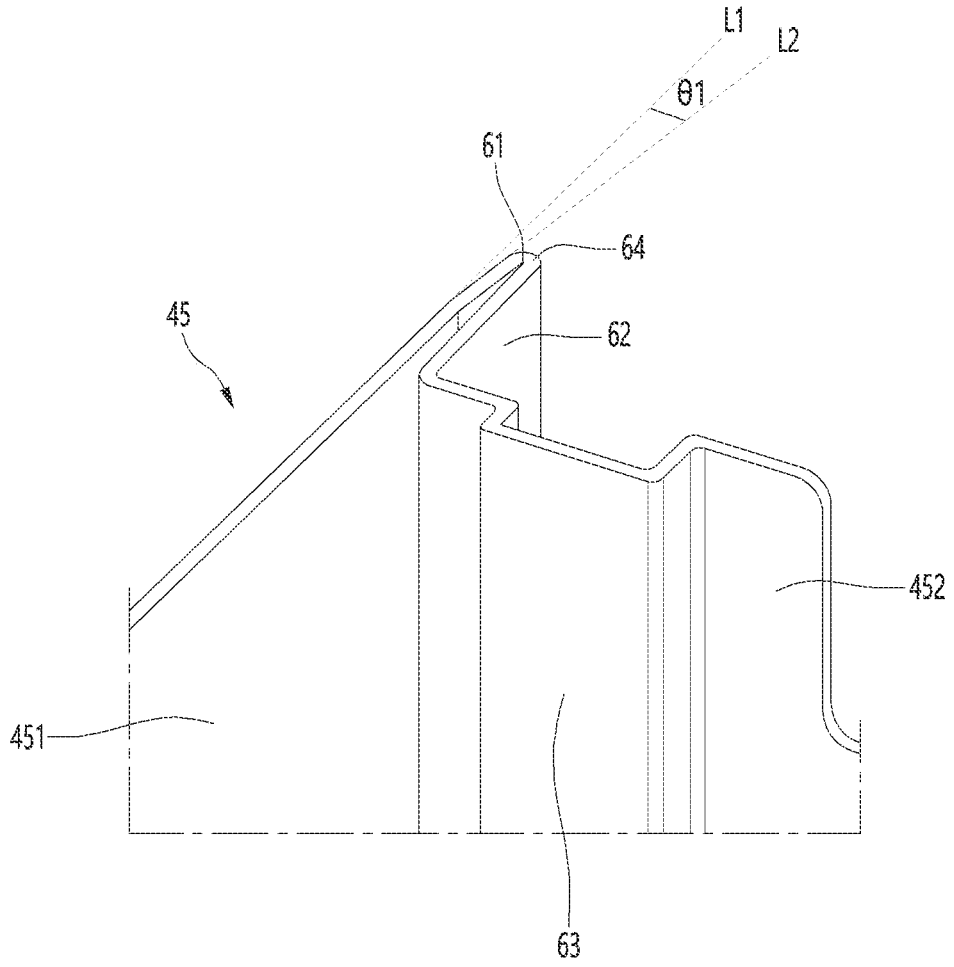
FIG. 7 is a diagram illustrating a cross-sectional view of n exemplary bent portion.
Figure 8:
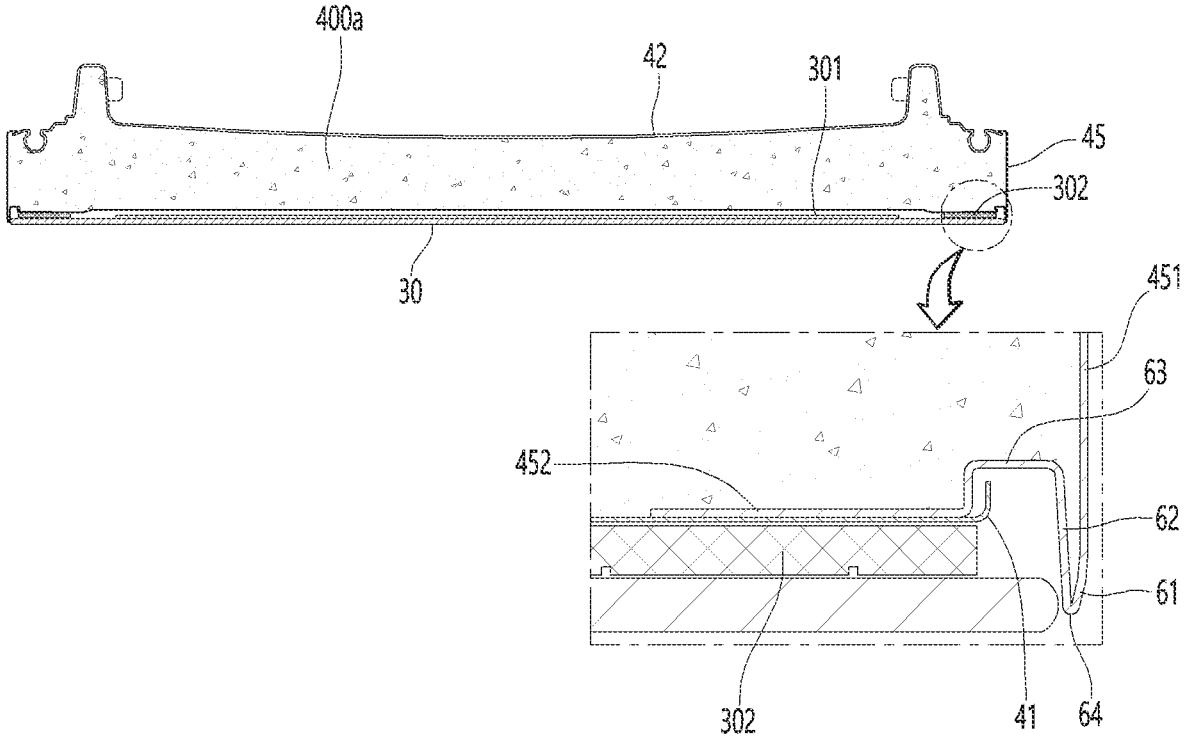
FIG. 8 is a diagram illustrating an example of a side coupling structure of a door.

FIG. 5 is a diagram illustrating an example of a state where a side decor is viewed from one side, FIG. 6 is a diagram illustrating an example of a state where a portion A of FIG. 5 is viewed from the other side, FIG. 7 is a diagram illustrating a cross-sectional view of an exemplary bent portion, and FIG. 8 is a diagram illustrating an example of a side coupling structure of a door.

The side decors 45 can be provided on both sides of the door body 40, respectively, to provide a side outer appearance of the door 20. For example, the side decor 45 can include a first side decor 45*a* and a second side decor 45*b*.

The first side decor 45*a* and the second side decor 45*b* can have similar configuration, respectively, except the first side decor 45 and the second side decor 45 are provided with mutual mirror symmetry.

The side decors 45 can directly connect the body cover 41 and the door liner 42, respectively, or cover a connection portion between the body cover 41 and the door liner 42.

The side decors 45 can be coupled with both side ends of the upper cap decor 43, respectively. In addition or alternatively, each side decor 45 can be coupled with both side ends of the lower cap decor 44.

The side decor 45 may be made of, for example, a metal material and can be made of an iron plate material.

The side decor 45 can include a first part 451 elongated in the vertical direction along both sides of the door body 40. The first part 451 can be positioned between the body cover 41 and the door liner 42 to provide a side surface of the door body 40.

An upper end portion of the first part 451 can be coupled to the upper cap decor 43. An upper extension portion 47 extending toward the upper cap decor 43 can be provided on an upper end of the first part 451. The upper extension portion 47 can extend upward from one side end of the first part 451 and can be coupled to the upper cap decor 43.

The upper extension portion 47 can be bent a plurality of times and then be provided by connecting upper end portions of the first part 451 and the second part 452. For example, the upper extension portion 47 can be provided integrally a first extension portion 471 extending from the first part 451 and a second extension portion 472 extending from the second part 452. The second extension portion 472 can provide a portion of the bent portion 60.

The upper extension portion 47 can further include a third extension portion 473 bent in the direction of the second part 452 from one end of the second extension portion 472. By the third extension portion 473, the upper extension portion 47 can be more firmly provided.

The upper extension portion 47 can define a space into which the upper decor coupling portions 439 provided on both sides of the upper cap decor 43 are inserted.

The second extension portion 472 can be provided by bending a plurality of times. In this case, it is possible to block the upper cap decor 43 from being detached while the upper decor coupling portion 439 is inserted into the upper extension portion 47.

A lower end portion of the first part 451 can be seated on the lower cap decor 44. For example, the lower end portion of the first part 451 can be provided such that at least a portion of both side portions of the lower cap decor 44 is in contact with each other.

The side decor 45 can include a second part 452 coupled to the body cover 41. The second part 452 can be bent and extended from one end of the first part 451 to be integrally provided.

The second part 452 can be provided in a direction crossing the first part 451. For example, the second part 452 can extend in an inward direction from the front end of the first part 451, that is, in a direction toward the center of the door panel 30.

The second part 452 can provide a surface that can be in contact with the door panel 30 so as to be coupled to the body cover 41.

The second part 452 can include a second part hole 452*a* enables the fastening member to pass therethrough. The second part hole 452*a* can be provided in plurality such that the plurality of second part holes 452*a* can extend along the vertical direction in which the second part 452 extends. The fastening member passing through the second part hole 452*a* can pass through the fastening hole 41*a* provided in the body cover 41, so that the side decor 45 and the body cover 41 can be coupled to each other.

A second lower part hole 452*b* capable of being coupled to the lower cap decor 44 can be provided at a lower end portion of the second part 452.

In some implementations, a second upper part hole 452*c* provided to be coupled to the upper cap decor 43 can be provided at an upper end portion of the second part 452.

The side decor 45 can include a third part 453 coupled to the door liner 42. The third part 453 can be provided integrally by being bent and extended from the other end of the first part 451.

For example, the third part 453 can extend in an inward direction from the rear end of the first part 451, that is, in a direction toward the center of the door panel 30.

The third part 453 can have a predetermined area to be coupled to the door liner 42.

A third lower part hole 453*a* provided to be coupled to the lower cap decor 44 can be provided at a lower end portion of the third part 453.

A length of the third part 453 bent and extended from one end of the first part 451 can be shorter than a length of the second part 452 bent and extended from one end of the first part 451.

In some implementations, a third upper part hole 453*b* provided to be coupled to the upper cap decor 43 can be defined at an upper end portion of the third part 453.

In some implementations, the side decor 45 can be disposed between the body cover 41 and the door liner 42 to be coupled to the body cover 41. In addition or alternatively, the side decor 45 can have a structure that can be coupled with the upper cap decor 43 or the lower cap decor 44.

In some implementations, the side decor 45 includes a bent portion 60. The bent portion 60 can contact one side end of the door panel 30.

The bent portion 60 can be provided between the first part 451 and the second part 452, for example. The first part 451 and the second part 452 can be connected by the bent portion 60.

The bent portion 60 can include a first bent portion 61 inclined at an angle set from the first part 451, and a second bent portion 62 inclined at an angle set from one end of the first bent portion 61.

For example, the first bent portion 61 can be bent at an angle set from the front end of the first part 451 to extend toward the door panel 30. As the first bent portion 61 moves toward the front from the front end of the first part 451, the first bending part can extend in a direction closer to the second part 452.

For example, the angle between an imaginary line L1 in a direction in which the first part 451 extends toward the door panel 30 and the imaginary lines L2 in a direction extending toward the door panel 30, for example, can be in the range of an acute angle. In some implementations, the angle may range from 5 to 60 degrees.

The second bent portion 62 can be provided by bending at one end of the first bent portion 61. For example, the second bent portion 62 can be bent at the front end of the first bent portion 61 so as to be in contact with both side ends of the door panel 30 at least in part.

In some implementations, the second bent portion 62 can be provided by bending rearward from the front end of the first bent portion 61. The second bent portion 62 can extend further rearward than a point where the first bent portion 61 and the first part 451 are connected.

In some implementations, as the second bent portion 62 may be provided to extend away from the door panel 30, that is, extends in the direction of the first part 451, the gap between the second bent portion 62 and the first bent portion 61 can increase. For example, the gap between the first bent portion 61 and the second bent portion 62 can become closer in a direction closer to the door panel 30.

For example, as the second bent portion 62 extends in a direction in which the first part 451 is located, it can extend in parallel to the direction in which the first part 451 is extended.

A gap between the first part 451 and the second bent portion 62 can be about 0.5 mm.

In some implementations, a gap between the front end of the second bent portion 62 and the front end of the first bent portion 61 can be about 0.1 mm.

The distance between the outer surface of the first bent portion 61 and the inner surface of the second bent portion 62 can be in the range of about 0.5 to 1.5 mm. For example, the length of the round portion 64 can be in a range of about 0.5 to 1.5 mm.

The first bent portion 61 can have a radius of curvature R of 10 to 20, about 16.

The first bent portion 61 and the second bent portion 62 can be connected to each other in a curved shape. For example, the first bent portion 61 and the second bent portion 62 can be connected by the round portion 64.

The round portion 64 can be provided at a position adjacent to a center line of the door panel 30 extending in the left and right direction.

In some implementations, a gap between the first bent portion 61 and the second bent portion 62 can become narrower toward the door panel 30, that is, toward the front.

For example, as the bent portion 60 extends in the direction of the door panel 30, a gap between the outer bent portion and the inner bent portion can become narrower. Such a structure can also be referred to as a chamfer structure.

In some implementations, the portion at which the round portion 64 is exposed from the front can be minimized.

The first bent portion 61 can provide at least a portion of an outer surface of the side decor 45. In some implementations, the second bent portion 62 can provide at least a portion of an inner surface of the side decor 45.

The first bent portion 61 can have a structure inclined to be closer to the door panel 30 as it extends toward the door panel 30. Due to this inclined structure, the first bent portion 61 can secure a relatively large area compared to the second bent portion 62.

Accordingly, in the process of mounting the door panel 30 to the door body 40, the door panel 30 can be more easily inserted into the door body 40 by the first bent portion 61.

In some implementations, the second bent portion 62 can have a smaller area than the first bent portion 61. For example, as the door panel 30 is mounted inside the door body 40, the gap between the second bent portion 62 and the door panel 30 can become narrower.

With this structure, when the door panel 30 is mounted on the door body 40, the space between the door panel 30 and the door body 40 can be minimized. For example, there is an advantage that can improve the quality of the outer appearance.

The second bent portion 62 can extend further rearward than the body cover 41 or can extend to a position corresponding to both side ends of the body cover 41.

The second bent portion 62 and the second part 452 can be connected by a stepped portion 63. The stepped portion 63 can be bent at the second bent portion 62 to extend in a direction in which both side ends of the body cover 41 are located.

The stepped portion 63 can be located further rearward than the second part 452. For example, the stepped portion 63 can be connected to the second part 452 with a step difference. An end portion bent from the side end of the body cover 41 can be inserted into the stepped portion 63, so that the body cover 41 and the side decor 45 can be coupled.

In some implementations, the side decor 45 can be firmly coupled to the body cover 41.

The second part 452 can be disposed behind the door panel 30 in a state where the second part is coupled to the body cover 41. In some implementations, the second bent portions 62 can be disposed at both side ends of the door panel 30.

Hereinafter, the mounting structure of the door panel 30 will be described in detail with reference to the drawings.

Figure 9:
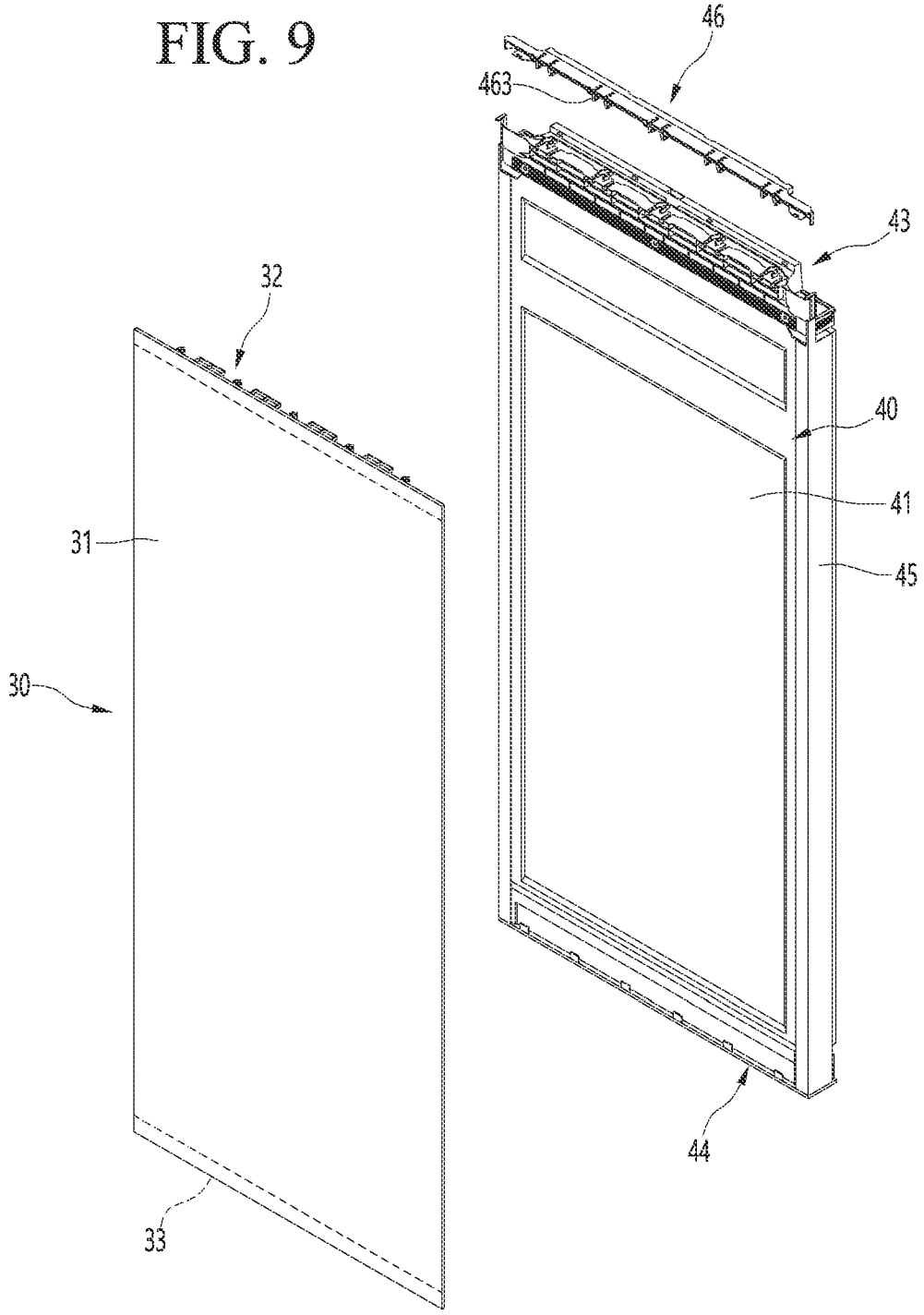
FIG. 9 is a diagram illustrating an example of a process of coupling the door body and the door panel.
Figure 10:
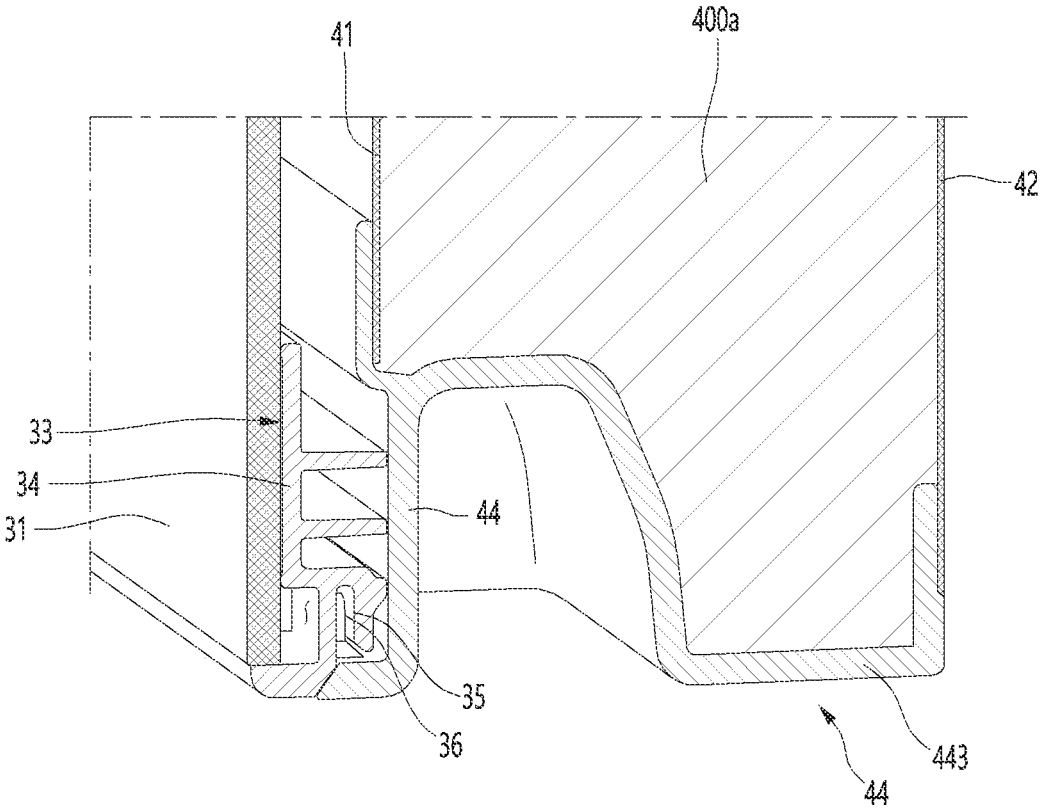
FIG. 10 is a diagram illustrating an example of a door lower coupling structure.
Figure 11:
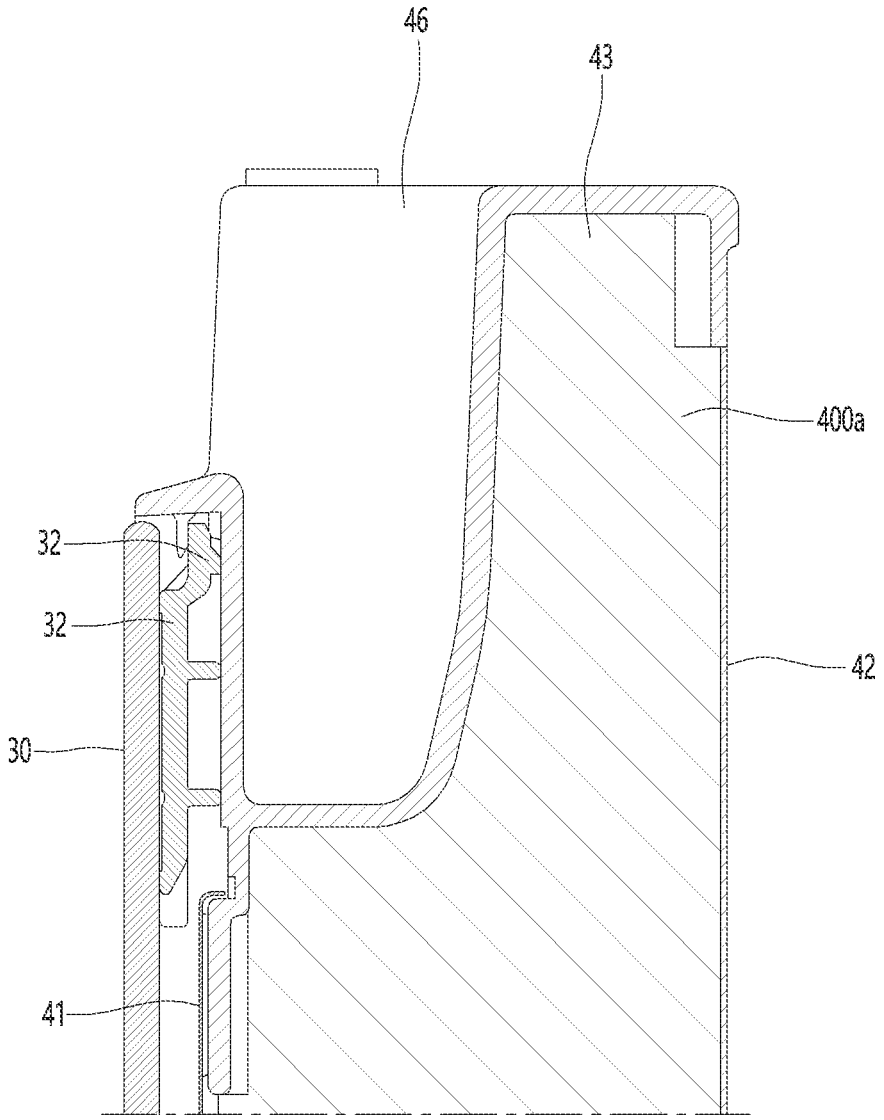
FIG. 11 is a diagram illustrating an example of a door upper coupling structure.

FIG. 9 is a diagram illustrating an example of a process of coupling the door body and the door panel, FIG. 10 is a diagram illustrating an example of a door lower coupling structure, and FIG. 11 is a diagram illustrating an example of a door upper coupling structure.

As illustrated in the drawing, the door panel 30 can be prepared in a state where the upper bracket 32 and the lower bracket 33 are attached to the panel 31.

In some implementations, the side decor 45 can be disposed on both sides of the door body 40 between the body cover 41 and the door liner 42. In some implementations, in the side decor 45, a fastening member or the like can pass through a fastening hole or a part hole to couple the body cover 41 and the side decor 45.

The upper cap decor 43 can be mounted on the upper end of the door body 40. The upper decor coupling portions 439 provided at both side ends of the upper cap decor 43 can be inserted into the upper extension portion 47, so that both side ends thereof can be coupled.

The lower cap decor 44 can be mounted at the lower end of the door body 40. Through the second and third lower part holes provided in the side decor 45, while the protrusion portion of the lower cap decor 44 penetrates, the side decor 45 and the lower cap decor 44 can be coupled to each other.

In order to mount the door panel 30, the door panel 30 may be brought to the front surface of the door body 40. At this time, both ends of the panel 31 in the left and right direction are mounted while disposing between the side decors 45.

In a state where the lower end of the door panel, that is, the lower bracket 33 is first caught and restrained in the lower cap decor 44, the door panel 30 can completely restrain the door panel 30 while the upper end thereof, that is, the upper bracket 32 is coupled to the upper cap decor 43 and the decor cover 46 is finally mounted.

First, looking at the coupling structure of the lower end of the door panel in more detail with reference to FIG. 10, the lower cap decor 44 is provided at the lower end of the door body 40 and can provide an outer appearance of a lower surface of the door 20 and the door body 40.

In the door panel 30, the upper bracket 32 can be coupled to the upper cap decor 43 in a state where the lower bracket 33 is caught and restrained by the lower cap decor 44. While the decor cover 46 is mounted above the upper cap decor 43, the door panel 30 can be completely restrained.

For example, by tilting the door panel 30 first, the restraining portion 441 of the lower cap decor 44 can be inserted into the chamber 36 of the lower bracket 33.

When the restraining portion 441 is accommodated in the chamber 36, the lower end of the door panel 30 can be mounted to the lower cap decor 44.

When the upper end of the door panel 30 is moved to the rear to couple the upper end of the door panel 30, in a state where the lower end of the door panel 30 is restrained, the door panel 30 rotates about the lower end thereof as an axis. When the upper end of the door panel 30 moves rearward, the mounting protrusion 322 protruding from the upper bracket 32 moves rearward. In some implementations, when the upper end of the door panel 30 is moved so that the mounting protrusion 322 is inserted into the protrusion accommodation portion 432, the upper end of the door panel 30 is coupled to the upper cap decor 43.

In this state, the door panel 30 can be temporarily coupled to the front surface of the door body 40 and the decor cover 46 can be mounted thereon. In the process in which the decor cover is mounted on the upper cap decor 43, the restraining portion 463 restrains the elastic deformation of the protrusion accommodation portion 432.

In addition, as illustrated in FIG. 8, in a state where the door body 40 and the door panel 30 are fully mounted, the bent portions 60 of the side decor 45 can be in contact with both side ends of the door panel 30. In this case, as the first bent portion 61 and the second bent portion 62 extend in the direction of the door panel 30, the gap between them can be narrowed. Accordingly, the process of mounting the door panel 30 to the door body 40 can be facilitated. In addition, by minimizing the gap between the door panel 30 and the door body 40, it is possible to increase the completeness of the outer appearance.

Hereinafter, a method for manufacturing the side decor 45 will be described in detail.

Figure 12:
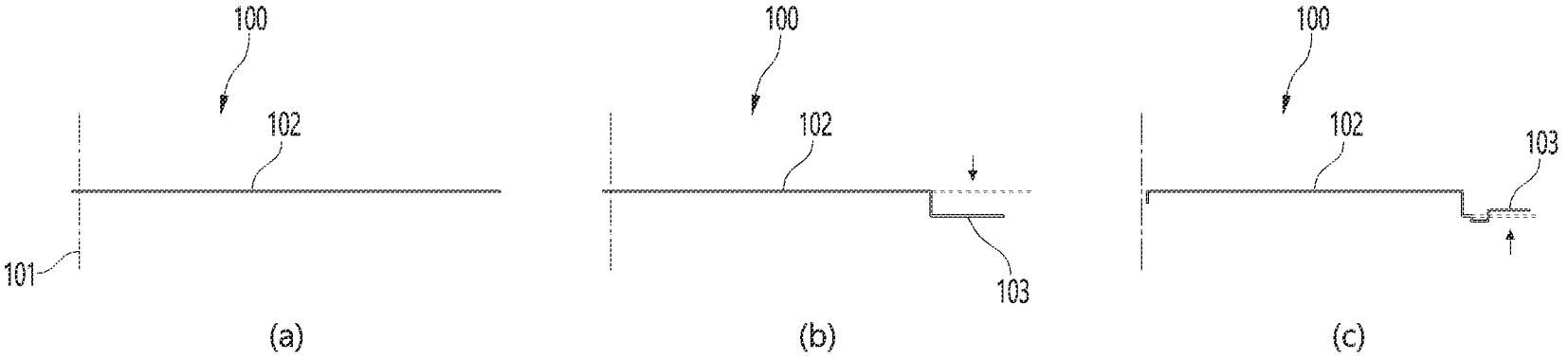
FIGS. 12A, 12B, and 12C are diagrams illustrating examples of first to third processes of manufacturing a side decor, respectively.
Figure 13:
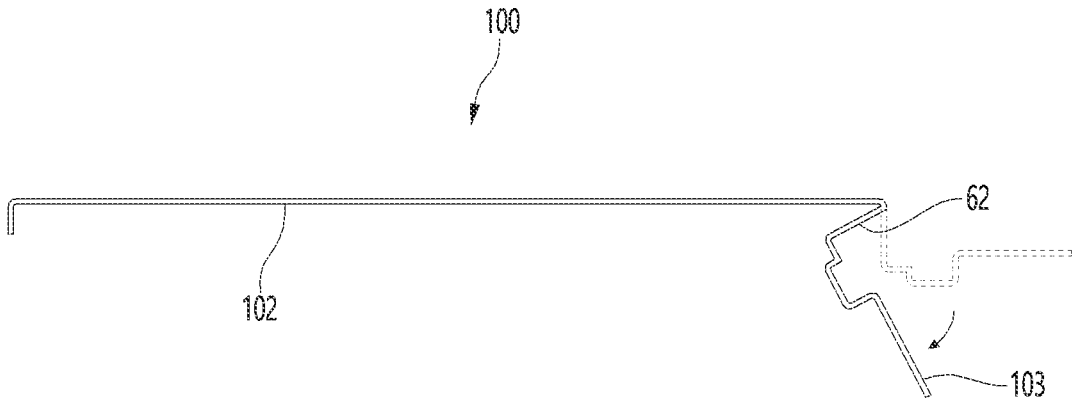
FIG. 13 is a diagram illustrating an example of a fourth process of manufacturing a side decor.
Figure 14:
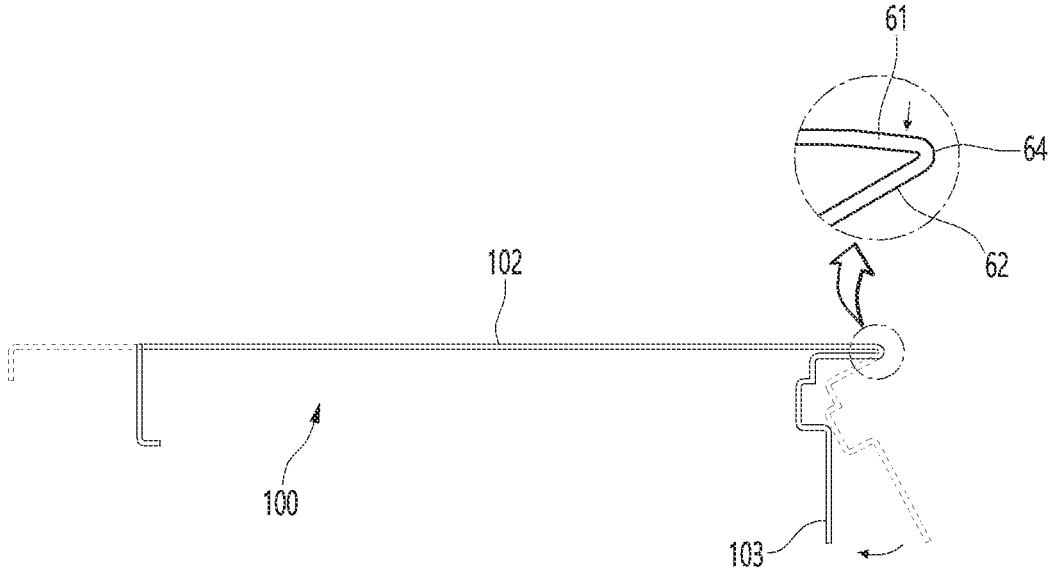
FIG. 14 is a diagram illustrating an example of a fifth process of manufacturing a side decor.
Figure 15:
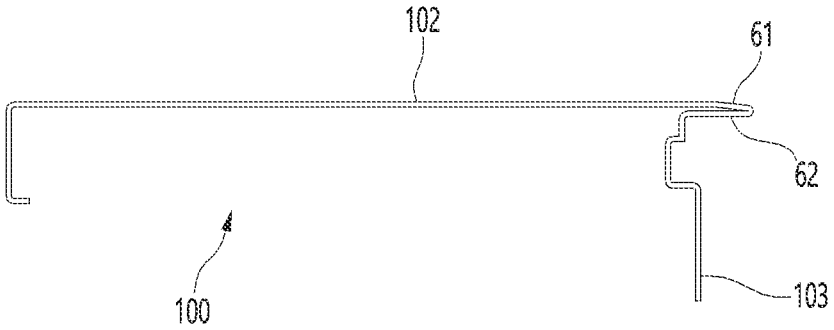
FIG. 15 is a diagram illustrating an example of a sixth process of manufacturing a side decor.

FIGS. 12A, 12B, and 12C are diagrams illustrating examples of first to third processes of manufacturing a side decor, respectively, FIG. 13 is a diagram illustrating an example of a fourth process of manufacturing a side decor, FIG. 14 is a diagram illustrating an example of a fifth process for manufacturing a side decor, and FIG. 15 is a diagram illustrating an example of a sixth process of manufacturing a side decor.

The side decor 45 can be made of, for example, a steel plate material such as stainless steel. In addition, the side decor 45 can be provided by press bending a single metal plate material 100.

The process of manufacturing the side decor 45 can include a process of cutting the metal plate material 100 along the cutting line 101.

A first process (FIG. 12A) of manufacturing the side decor 45 can include a piercing process, a forming process, including a notching process which cuts according to the plate shape. A plate shape suitable for manufacturing the side decor 45 can be manufactured by the first process.

A second process (FIG. 12B) of manufacturing the side decor 45 can include Z-bending. By the second process, one side portion 102 and the bent portion 103 may be bent to form an angle of approximately 90 degrees.

A third process (FIG. 12C) of manufacturing the side decor 45 can include a Z-bending (Up) process and a separating process. At least a portion of the bent portion 103 can be bent to form an angle of approximately 90 degrees by the third process.

A fourth process of manufacturing the side decor 45 can include a CAM-bending process. In addition, the fourth process can include a bending process.

By the fourth process, the bent portion 103 can be bent to form an angle of approximately 45 degrees with the side portion 102. At this time, the curvature of the die may be changed so that the connecting portion of the bent portion 60 and the side portion 102 can be connected to each other a round manner.

In some implementations, a fifth process of manufacturing the side decor 45 can include a CAM-Hemming process. In addition, the fifth process can include a bending process.

The inclination of the first bent portion 61 described above can be gently bent by the fifth process, so that the first bent portion can be connected to the second bent portion 62 in a round manner.

In addition, in the fifth process, an insert can be inserted between a stripper and a cam-punch. By inserting the insert, an inclination can be formed at the side end of the first bent portion 61 so that the gap between the first bent portion 61 and the second bent portion 62 can be formed to be narrower toward the door panel 30.

A sixth process of manufacturing the side decor 45 can include a restriking process and a cam-piercing process.

Through the sixth process, the gap between the first bent portion 61 and the second bent portion 62 can be more reliably adjusted.

In the sixth process, an insert can be inserted between a stripper and a cam-punch. In a state where the insert is inserted, bending can be performed.

Through this process, the bent portion 60 formed on the side decor 45 can form the first bent portion 61 forming the outer surface and the second bent portion 62 forming the inner surface. In addition, the gap between the first bent portion 61 and the second bent portion 62 can be formed to be narrower as it extends in the direction of the door panel 30.

With this structure, it is possible to easily insert the door panel 30 into the door body 40, thereby improving assembly properties. In addition, as the door panel 30 is inserted into the door body 40, the gap between the door panel 30 and the door body 40 is reduced, so that the quality of the outer appearance can be improved.

Figure 16:
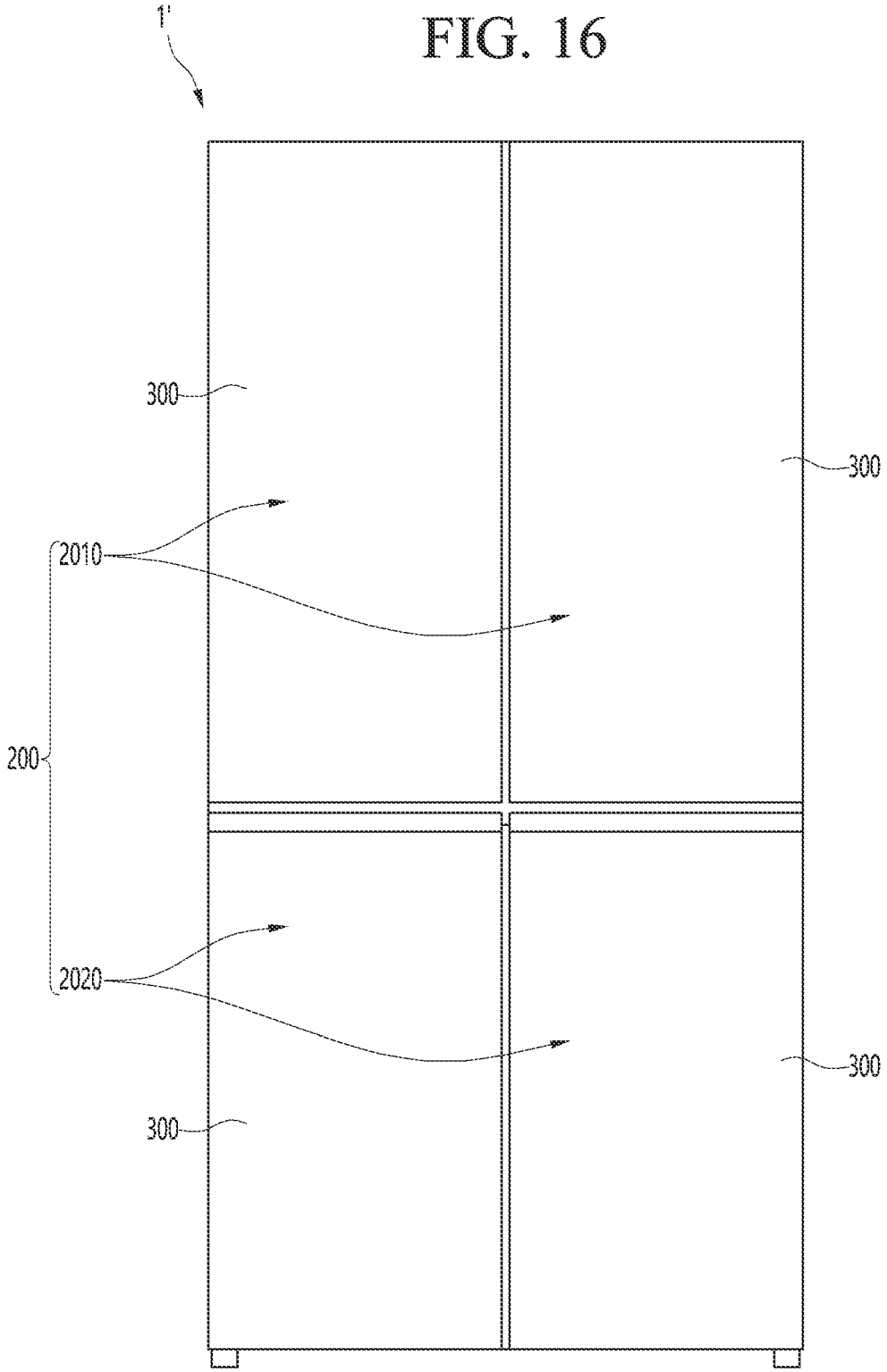
FIG. 16 is a diagram illustrating an example of the front surface of a refrigerator.
Figure 17:
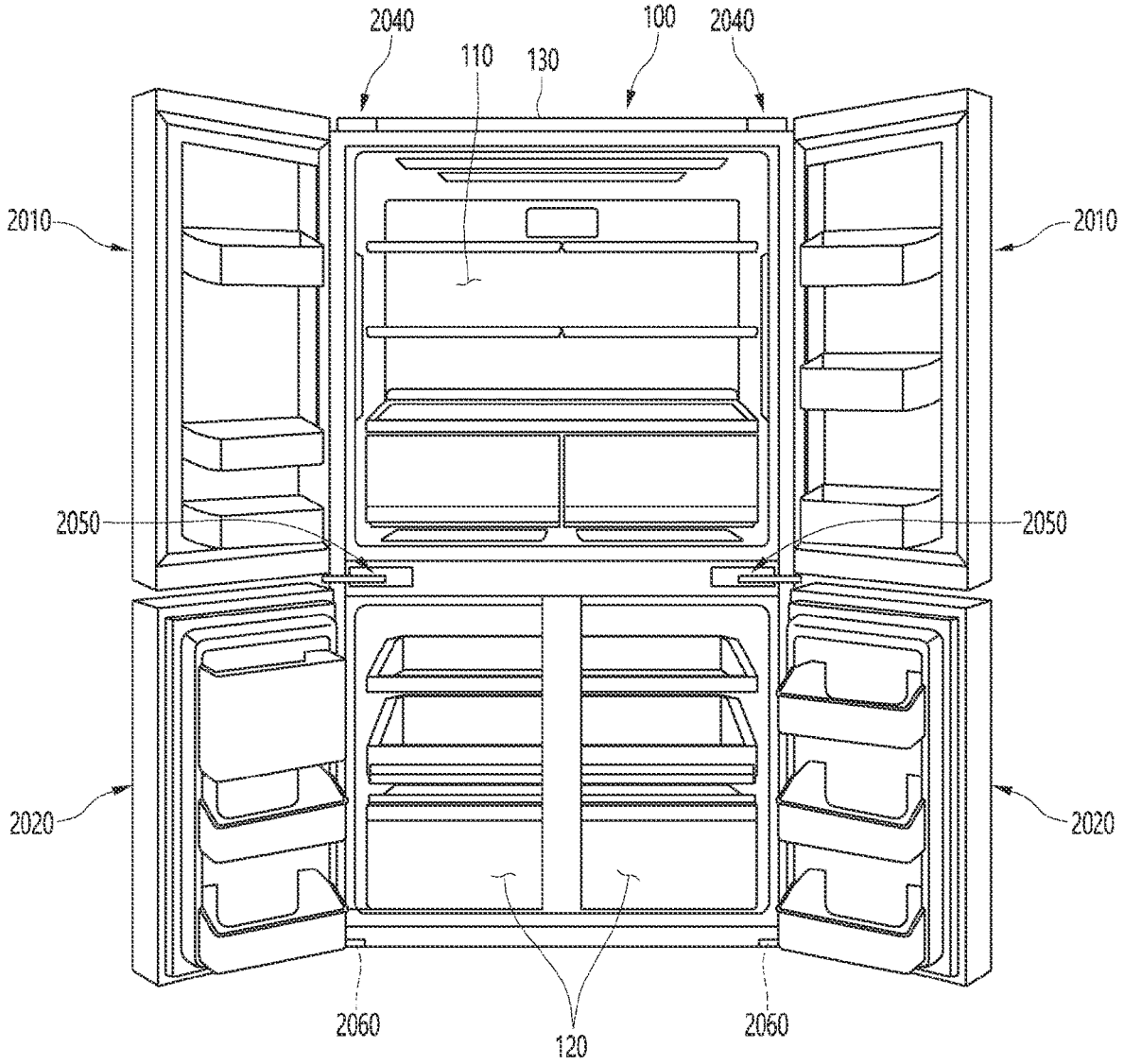
FIG. 17 is a diagram illustrating an example of the front surface of a state where the refrigerator door is opened.

FIG. 16 is a diagram illustrating another example of the front surface of a refrigerator, and FIG. 17 is a diagram illustrating an example of the front surface of a state where the refrigerator door is opened.

The refrigerator 1' can have an external shape provided by a cabinet 10 defining a storage space and a door 200 configured to open and close the storage space of the cabinet 10.

The cabinet 10 can define a storage space divided in the vertical direction, a refrigerating chamber 110 can be provided at an upper portion, and a freezing chamber 120 can be provided at a lower portion. The refrigerating chamber 110 can be referred to as an upper storage space, and the freezing chamber 120 can be referred to as a lower storage space.

A control box 13 can be provided in the cabinet 10. In the control box 13, a controller for controlling the operation of the refrigerator 1' can be disposed.

The door 200 can be configured to open and close the refrigerating chamber 110 and the freezing chamber 120, respectively. The door 200 can include a refrigerating chamber door 2010 for opening and closing the refrigerating chamber 110 and a freezing chamber door 2020 for opening and closing the freezing chamber 120.

In some implementations, a pair of the refrigerating chamber doors 2010 can be disposed side by side on both sides in the left and right direction, and each refrigerating chamber door 2010 can partially open and close the refrigerating chamber 110. A pair of the freezing chamber doors 2020 can be disposed side by side on both sides in the left and right direction and can open and dose the freezing chamber 120 divided on both sides in the left and right direction, respectively.

Since the refrigerating chamber door 2010 is provided at the upper portion of the cabinet 10, the refrigerating chamber door 2010 can be referred to as an upper door, and since the freezing chamber door 2020 is provided at the lower portion of the cabinet 10, the freezing chamber door 2020 can be referred to as a lower door.

The door 200 can be rotatably mounted to the cabinet 10 by being connected by hinge devices 204, 205, and 206 and can open and dose the refrigerating chamber 110 and the freezing chamber 120 by rotation, respectively.

For convenience of explanation and understanding, a refrigerator having a structure in which the refrigerating chamber 110 is disposed above and the freezing chamber 120 is disposed below will be described as an example.

In some implementations, the door 200 can provide the front outer appearance of the refrigerator 1' in the closed state and provide the outer appearance of the refrigerator 1' viewed from the front in a state where the refrigerator 1' is installed.

Hereinafter, the structure of the door 200 will be described in detail with reference to the drawings. In addition, the present disclosure will be described with reference to the refrigerating chamber door 2010, and other doors may have the same structure only with a difference only in the mounting position.

Figure 18:
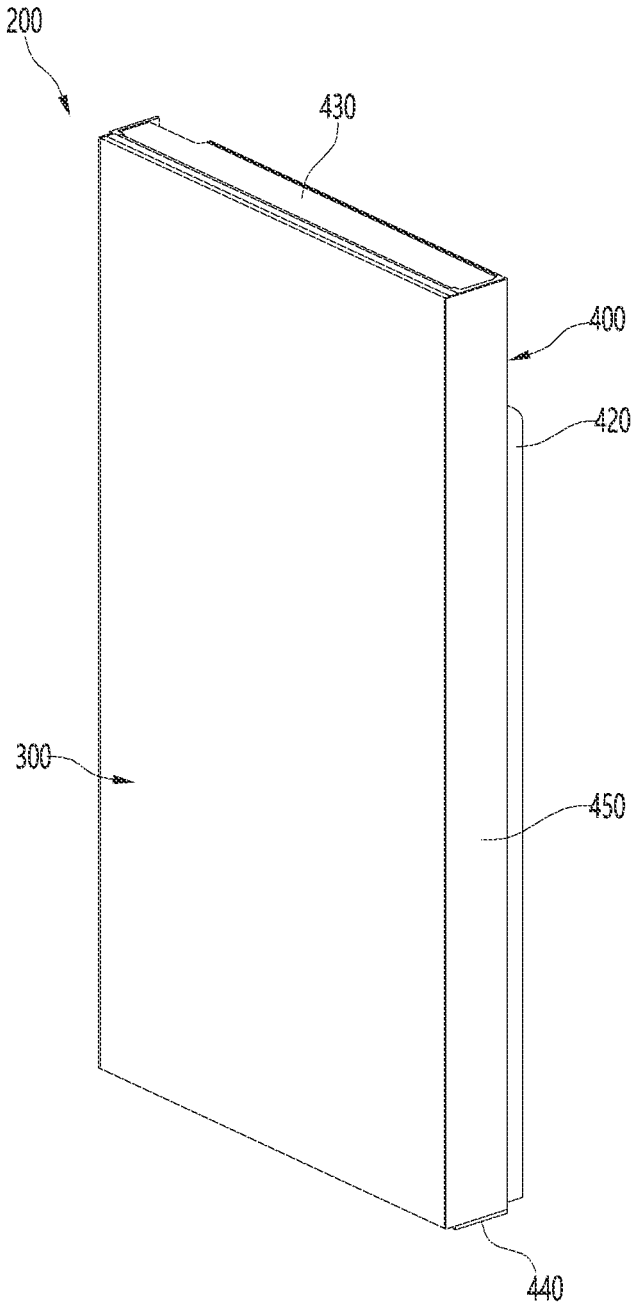
FIG. 18 is a diagram illustrating an example of a door of the refrigerator.
Figure 19:
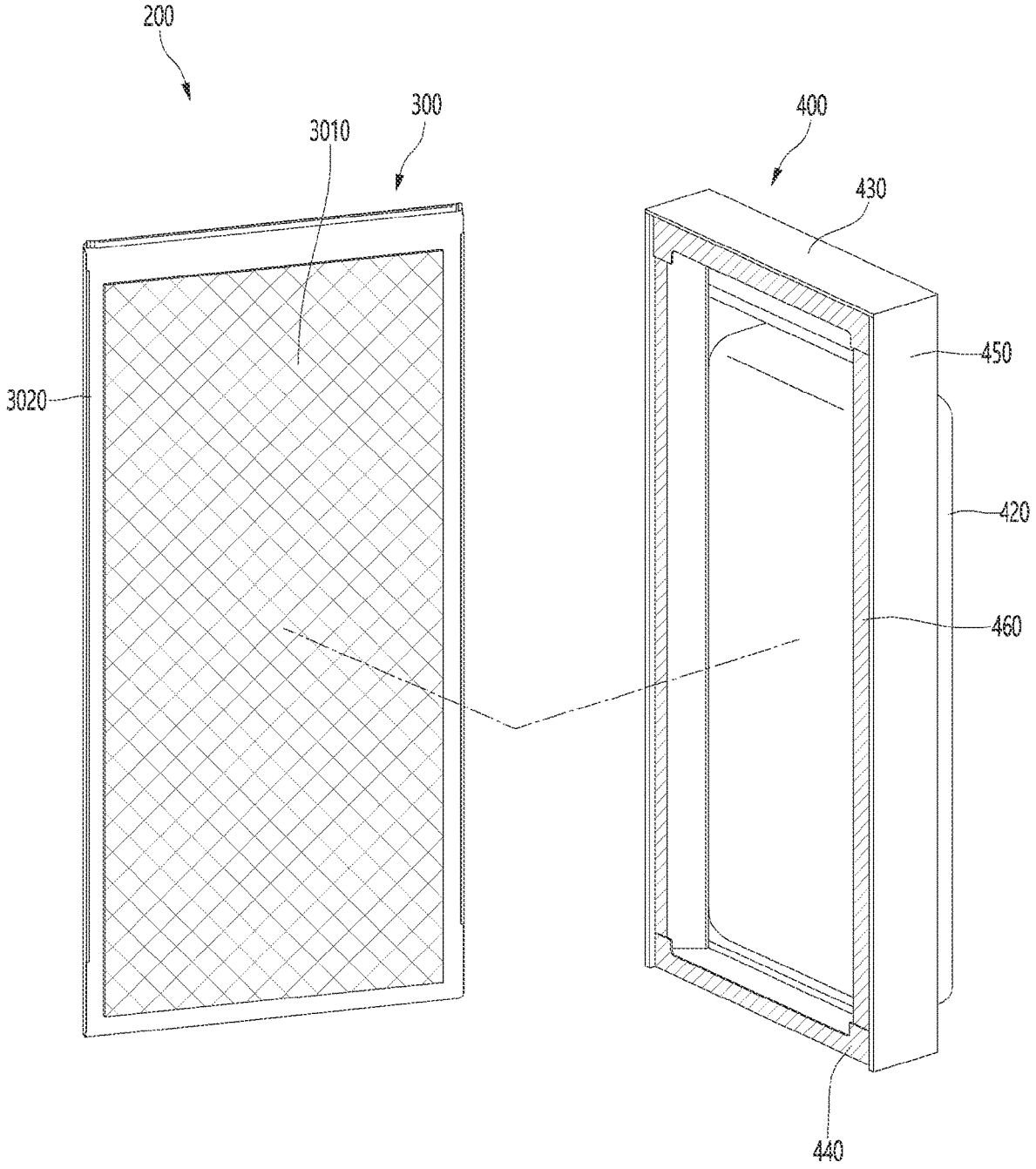
FIG. 19 is a diagram illustrating an example of a state where the refrigerator door is separated into a door body and a door panel.
Figure 20:
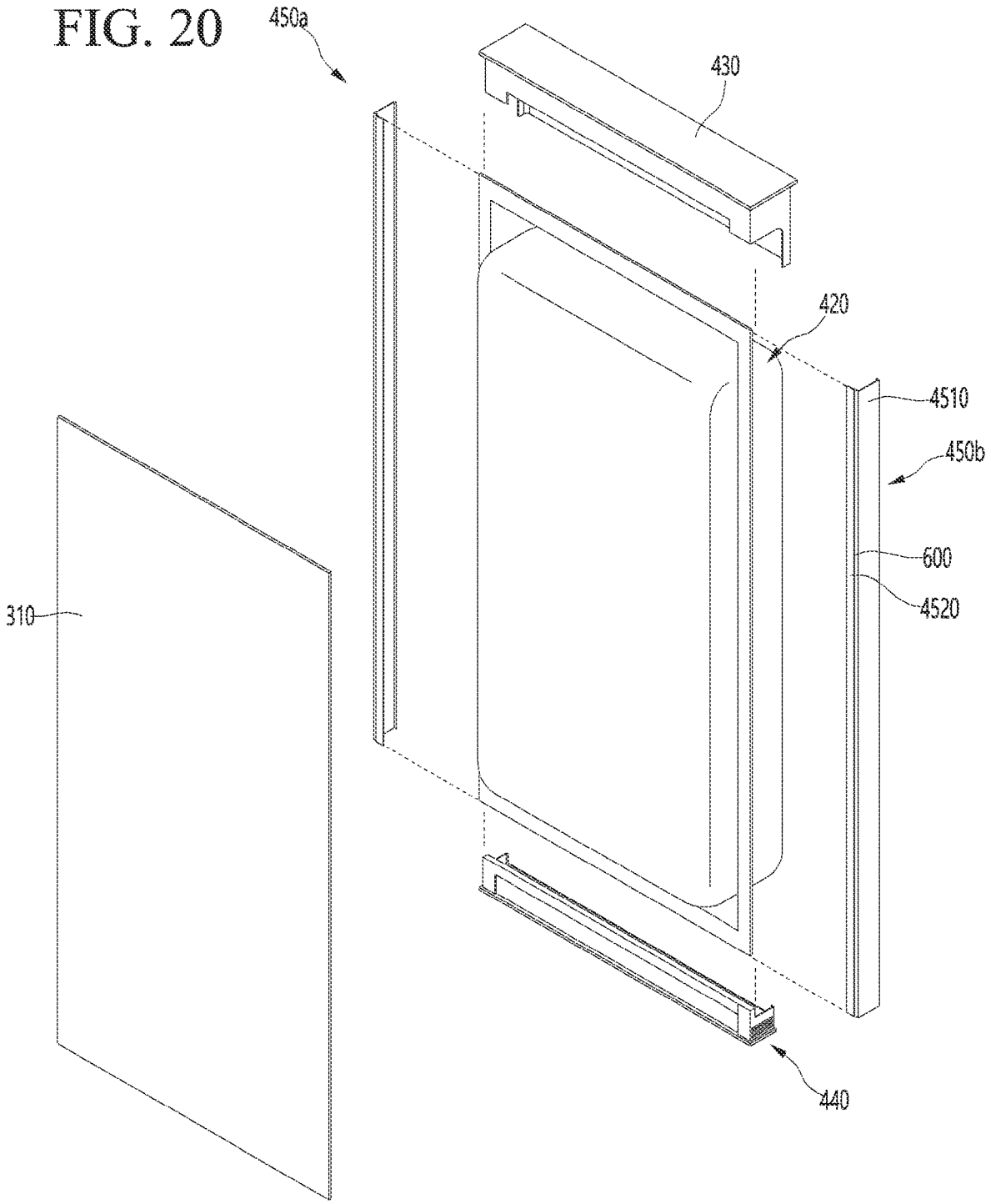
FIG. 20 is a diagram illustrating an example of a state where the door panel and the door body are separated from each other.
Figure 21:
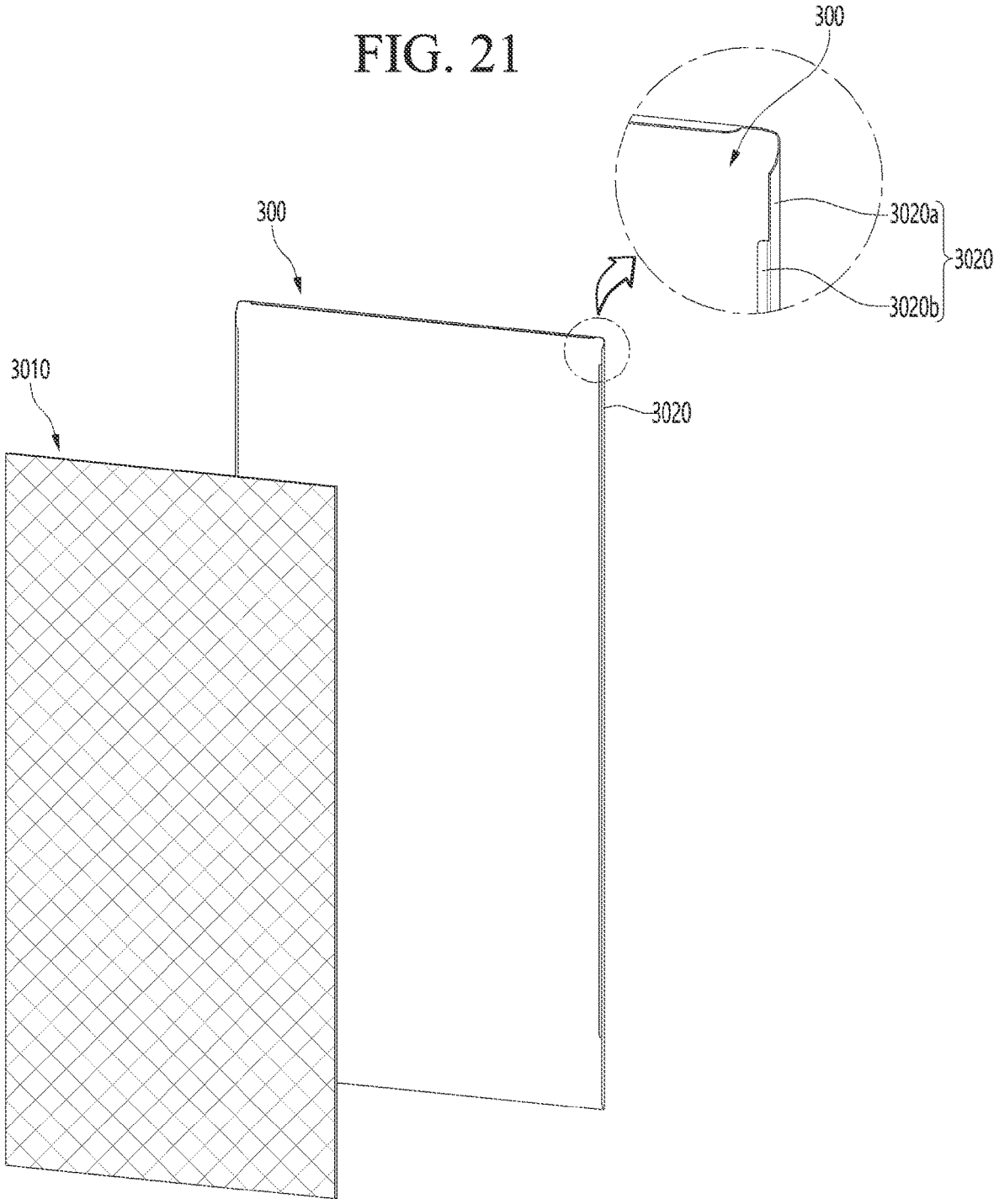
FIG. 21 is a diagram illustrating an example of the door panel.

FIG. 18 is a diagram illustrating an example of a door of the refrigerator, FIG. 19 is a diagram illustrating an example of a state where the refrigerator door is separated into a door body and a door panel, FIG. 20 is a diagram illustrating an example of a state where the door panel and the door body are separated from each other, and FIG. 21 is a diagram illustrating an example of the door panel.

The door 200 can include a door body 400 and a door panel 300 coupled to the front surface of the door body 400.

The door body 400 can provide the overall shape of the door 200. The door body 40 can be configured to open and close the storage space and can serve as insulation components of the storage space.

The door body 400 can include a door liner 420 providing a rear surface. In some implementations, the door body 400 can include an upper cap decor 430 providing an upper surface and a lower cap decor 440 providing a lower surface.

In some implementations, the door body 400 can further include a body cover that provides a front surface of the door body 400 and that is in contact with the rear surface of the door panel 300.

In some implementations, the door body 400 can include side decors 450 providing both sides in the left and right direction. The side decor 450 can be coupled to the body cover and the door liner 420.

The door liner 420 can provide a rear surface of the door body 400. The door liner 420 can be made of a plastic material. An insulation material 400 can be provided between the door panel 300 and the door liner.

The upper cap decor 430 can provide an upper surface of the door body 400. The lower cap decor 440 can provide the lower surface of the door body 400.

The side decor 450 can be provided on both sides of the body cover 41 and the door liner 420. The side decor 450 can connect the side ends of the body cover 41, the door liner 420, the upper cap decor 430, and the lower cap decor 440 in the left and right direction to provide both sides of the door body 400 in the left and right direction.

The side decor 450 can be provided with a bent portion 600 protruding further forward than the door body 400. When the door panel 300 is mounted on the door body 400, the bent portion 600 can support both ends of the door panel 300 in the left and right direction.

The door panel 300 can be mounted on the front surface of the door body 400 to provide the front outer appearance of the door 200. The door panel 300 can correspond to the size of the door body 400. Accordingly, the front surface of the door body 400 can be covered by the door panel 300 and may not be exposed to the outside.

The door panel 300 can have various materials, colors, and designs. For example, the door panel 300 can be made of a metal material such as glass or a resin material or a stainless steel plate.

The door panel 300 can be provided with a buffer member 3010. The buffer member 3010 can be attached to the rear surface of the door panel 300.

For example, when the door panel 300 is mounted on the door body 400, a space between the panel 31 and the door body 400 can be filled by the buffer member.

Accordingly, even if an impact is applied to the front surface of the door panel 300 or pressure is applied to the inside by foaming for forming an insulation material or the like, it is possible to block the door panel 300 from being deformed or damaged.

The buffer member 3010 can be made of, for example, urethane foam. Specifically, the buffer member 3010 can be urethane foam having an adhesive attached to one surface thereof. In some implementations, flexible urethane foam for the buffer member 3010 can be used in terms of blocking deformation even when pressure is applied to the door panel 300 when the foam material is filled.

In some implementations, side decors 450 can be provided on both sides of the door panel 300 and the door body 400. Hereinafter, another exemplary the side decor 450 will be described in detail.

Figure 22:
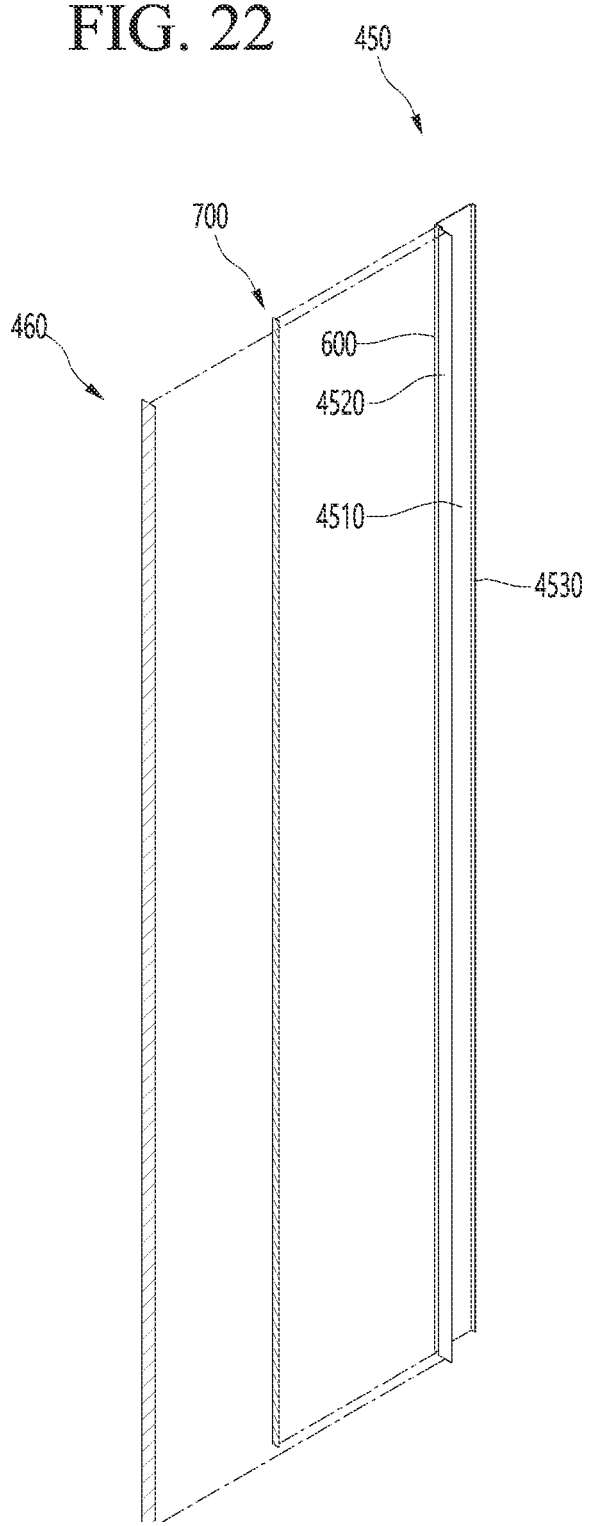
FIG. 22 is a diagram illustrating an example of a state where the side decor of the door is viewed from one side.

FIG. 22 is a perspective view illustrating a state where the side decor of the door is viewed from one side.

The side decors 450 can be provided on both sides of the door body 400, respectively, to provide a side outer appearance of the door 200. For example, the side decor 450 can include a first side decor 450*a* and a second side decor 450*b*.

The configurations of the first side decor 450 and the second side decor 450 may be similar, except that the first side decor 450 and the second side decor 450 are provided with mutual mirror symmetry.

Each side decor 450 can directly connect the door panel 300 and the door liner 420 or cover a connection portion between the door panel 300 and the door liner 420.

Each side decor 450 can be coupled to both side ends of the upper cap decors 430. In addition, each side decor 450 can be coupled with both side ends of the lower cap decor 440.

The side decor 450 may be made of, for example, a metal material, but is not limited thereto, and may be made of an iron plate material.

The side decor 450 can include first parts 4510 elongated in the vertical direction along both sides of the door body 400. The first part 4510 can be positioned between the door panel 300 and the door liner 420 to provide a side surface of the door body 400.

An upper end portion of the first part 4510 can be coupled to the upper cap decor 430.

The side decor 450 includes a second part 4520 coupled to the door panel 300. The second part 4520 can be bent and extended from one end of the first part 4510 to be integrally provided.

The second part 4520 can be provided in a direction crossing the first part 4510. For example, the second part 4520 can extend in an inward direction from the front end of the first part 4510, that is, in a direction toward the center of the door panel 300.

The second part 4520 can provide a surface that can contact the door panel 300 so as to be coupled to the door panel 300.

An adhesive portion 460 for bonding to the door panel 300 can be provided in the second part 4520. The adhesive portion 460 can be provided on at least a portion in contact with the door panel 300 and the second part 4520. The adhesive portion 460 can be a double-sided tape or the like. The door panel 300 and the second part 4520 can be coupled to each other by the adhesive force of the adhesive portion 460.

When the door panel 300 and the side decor 450 are adhered by the adhesive portion 460, regardless of whether the material of the door panel 300 is a glass material or a metal material, there can be an advantage that the door panel 300 can be easily mounted on the door body 400, In addition, since the door panel 300 and the door body 400 can be mounted by the adhesive portion 460, there can be an advantage in that the material cost for the fixing structure is reduced.

In some implementations, the second part 4520 may be coupled to the door panel 300 by a fastening member.

In some implementations, the door body 400 can further include a body cover that provides the front surface of the door body 400 and supports the door panel 300 from the rear.

For example, the second part 4520 can have a second part hole defining an opening so that the fastening member can pass therethrough. The fastening member passing through the second part hole can pass through the fastening hole provided in the body cover, so that the side decor 450 and the door panel 300 can be coupled.

The side decor 450 can include a third part 4530 coupled to the door liner 420. The third part 4530 can be formed integrally by being bent and extended from the other end of the first part 4510.

For example, the third part 4530 can extend in an inward direction from the rear end of the first part 4510, that is, in a direction toward the center of the door panel 300.

The third part 4530 can have a predetermined area to be coupled to the door liner 420.

A third lower part hole provided to be coupled to the lower cap decor 440 may be formed at the lower end portion of the third part 4530.

A length of the third part 4530 bent and extended from one end of the first part 4510 can be shorter than a length of the second part 4520 bent and extended from one end of the first part 4510.

In addition, a third upper part hole provided to be coupled to the upper cap decor 430 can be provided at the upper end portion of the third part 4530.

In some implementations, the side decor 450 can be disposed between the door panel 300 and the door liner 420 to provide both sides of the door.

In some implementations, the side decor 450 can have a structure that can be coupled with the upper cap decor 430 or the lower cap decor 440 as needed.

In some implementations, the side decor 450 includes a bent portion 600. The bent portion 600 can contact one side end of the door panel 300.

For example, the bent portion 600 can be provided between the first part 4510 and the second part 4520. The first part 4510 and the second part 4520 can be connected by the bent portion 600.

The bent portion 600 can include a first bent portion 610 inclining from an angle set in the first part 4510 and a second bent portion 620 inclining from an angle set at one end of the first bent portion 610.

For example, the first bent portion 610 can be extend at an angle set at the front end of the first part 4510 toward the door panel 300. The first bent portion 610 can extend from the front end of the first part 4510 toward the front in a direction closer to the second part 4520.

The second bent portion 620 can be provided by bending at one end of the first bent portion 610. For example, the second bent portion 620 can be bent at the front end of the first bent portion 610 so as to be in contact with both side ends of the door panel 300 at least in part.

The first bent portion 610 and the second bent portion 620 can be connected to each other in a curved shape. For example, the first bent portion 610 and the second bent portion 620 can be connected by the round portion 640.

The round portion 640 can be provided at a position adjacent to a center line of the door panel 300 extending in the left and right direction.

In some implementations, the gap between the first bent portion 610 and the second bent portion 620 can be narrower toward the door panel 300, that is, toward the front.

For example, as the bent portion 600 extends in the direction of the door panel 300, a gap between the outer bent portion and the inner bent portion may become narrower. Such a structure may also be referred to as a chamfer structure.

In some implementations, the portion at which the round portion 640 is exposed from the front can be minimized.

The first bent portion 610 can provide at least a portion of an outer surface of the side decor 450. In some implementations, the second bent portion 620 can provide at least a portion of an inner surface of the side decor 450.

The first bent portion 610 can have a structure inclined to be closer to the door panel 300 as the first bent portion extends in the door panel 300 direction. According to the inclined structure, the first bent portion 610 can secure a relatively large area compared to the second bent portion 620.

Accordingly, in the process of mounting the door panel 300 to the door body 400, the door panel 300 can be more easily inserted into the door body 400 by the first bent portion 610.

In some implementations, the second bent portion 620 can have a smaller area than the first bent portion 610. In this case, as the door panel 300 is mounted inside the door body 400, the gap between the second bent portion 620 and the door panel 300 may become narrower.

In some implementations, when the door panel 300 is mounted on the door body 400, the space between the door panel 300 and the door body 400 can be minimized, such that there is an advantage that can improve the quality of the outer appearance.

Hereinafter, the coupling structure of the door panel and the door body will be described in detail.

Figure 23:
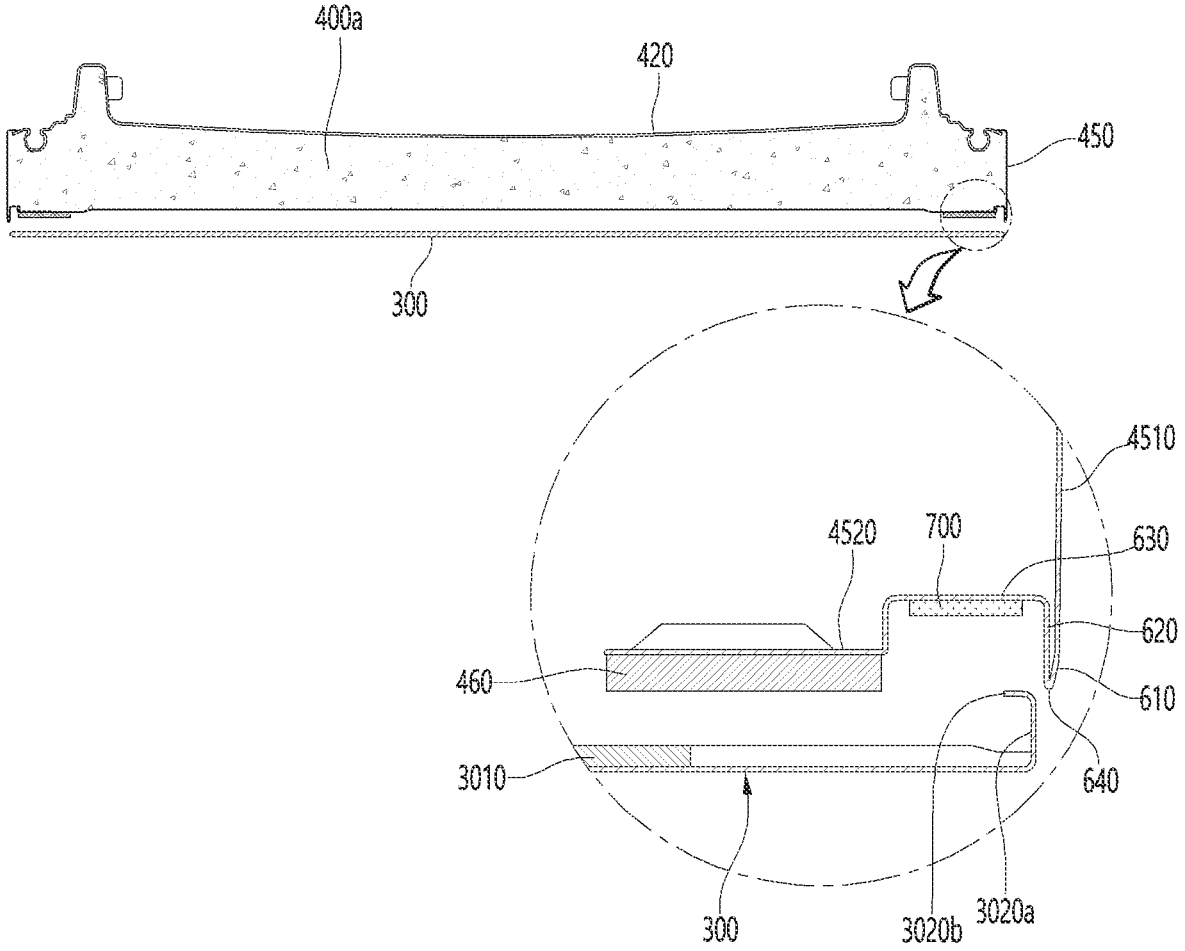
FIG. 23 is a diagram illustrating a cross-sectional view of another exemplary state before the door panel and the door body are coupled.
Figure 24:
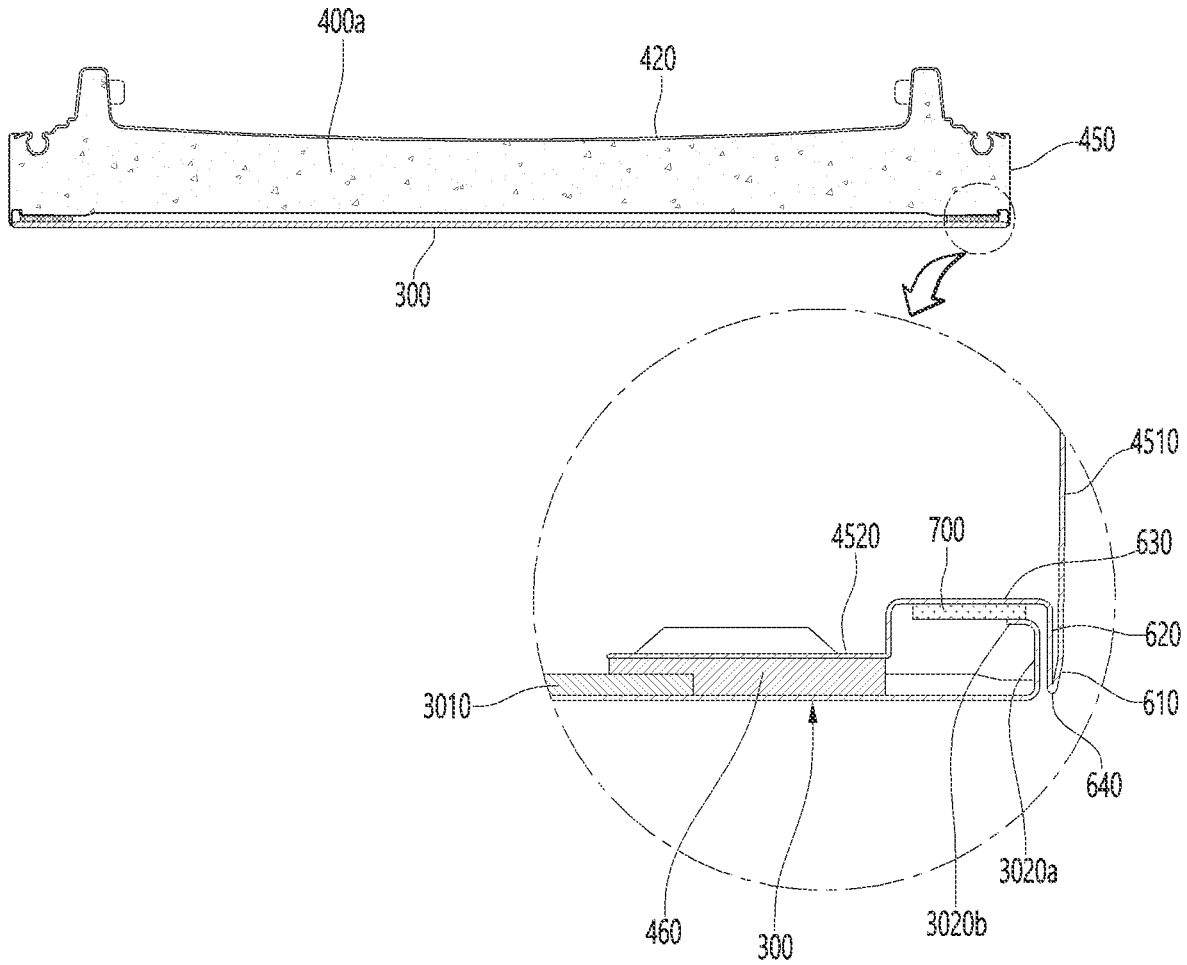
FIG. 24 is a diagram illustrating a cross-sectional view of another example of a coupling structure of a door panel and a door body.

FIG. 23 is a diagram illustrating a cross-sectional view of a state before the door panel and the door body are coupled, and FIG. 24 is a diagram illustrating a cross-sectional view of a coupling structure of a door panel and a door body.

The door 200 can include a door body 400 and a door panel 300 coupled to the front surface of the door body 400.

In some implementations, the door panel 300 can be made of a metal material such as stainless steel. For example, the door panel 300 can be made of an iron plate material.

The door panel 300 can be provided with a bent portion 3020 bent inwardly to be rounded at ends of the door panel 300 in the left and right direction. The bent portion 3020 can include a first bent portion 3020*a* bent from the front to the rear of the door panel 300, and a second bent portion 3020*b* bent from the first bent portion 3020*a* to the inside of the door panel 300.

The bent portion 3020 can prevent scratches from the process of assembling the door panel 300 to the door body 400.

In some implementations, when the door panel 300 is mounted on the door body 400, the side decor 450 forming both sides of the door body 400 includes a stepped portion 630 to provide a space in which the bent portion 3020 can be accommodated.

The stepped portion 630 can be provided between the bent portion 600 and the second part 4520 in the side decor 450.

For example, the stepped portion 630 can extend from one end of the bent portion 600. The stepped portion 630 can be recessed further rearward than the front end of the bent portion 600. For example, the stepped portion 630 can be recessed further rearward than the second part 4520 in which the adhesive portion 460 is provided.

In some implementations, the bent portion 3020 can be disposed to be spaced apart from the stepped portion 630.

For example, the distance at which the stepped portion 630 is spaced apart from the rear surface of the door panel 300 in the horizontal direction can be longer than the distance at which the bent portion 3020 extends rearwardly from the door panel 300.

In some implementations, the second bent portion 3020*b* and the stepped portion 630 can be disposed in parallel to face each other, and a predetermined space can be provided between the stepped portion 630 and the second bent portion 3020*b*.

A flow prevention foam 700 can be provided between the bent portion 3020 and the stepped portion 630. For example, the flow prevention foam 700 can be provided to fill the space between the bent portion 3020 and the stepped portion 630. In the process of filling the foaming material to form an insulation material in a state where the door panel 300 is mounted on the door body 400, the flow prevention foam 700 can block the door panel 300 formed of a metal material from deforming by impact.

In some implementations, the flow prevention foam 700 fills the space between the bent portion 3020 and the stepped portion 630, thereby blocking the side end portion of the door panel 300 from flowing. For example, it is possible to prevent a tolerance from occurring between the door panel 300 and the door body 400.

The flow prevention foam 700 can be made of a foam made of plastic material. For example, the flow prevention foam can be a foam made polyethylene as a raw material. In this case, there is an excellent advantage in blocking flow and deformation of the door panel 300. This flow prevention foam 700 can refer to a flow prevention portion.

The thickness of the flow prevention foam 700 (in other words, the distance extended forward from the stepped portion 630) is not limited. In some implementations, a thickness of the flow prevention foam 700 is sufficient to fill the gap between the bent portion 3020 and the stepped portion 630.

The flow prevention foam 700 can be longer than the distance in which the second bent portion 3020*b* extends from the first bent portion 3020*a*. For example, the flow prevention foam 700 can be shorter than the length in the horizontal direction (the length in the left and right direction) of the stepped portion 630 and can be longer than the distance of the second bent portion 3020*b* in the horizontal direction (the length in left and right direction). In this case, there is an advantage that the second bent portion 3020*b* can be more stably supported by the flow preventing foam 700.

In some implementations, the door panel 300 can be coupled to each other by the door body 400 and the adhesive portion 460. The adhesive portion 460 can be provided on the second part 4520 of the side decor 450. In addition, the adhesive portion 460 can be provided on at least a portion of the front surface of the upper cap decor 430. In some implementations, the adhesive portion 460 can be provided on at least a portion of the front surface of the lower cap decor 440.

When the door panel 300 is made of a metal material, the thickness of the adhesive portion 460 can be less than the thickness of the bent portion 3020. For example, the length of the adhesive portion 460 in the front and rear direction can be shorter than the length of the first bent portion 3020*a* in the front and rear direction.

A rear end of the first bent portion 3020*a* can extend further rearward than the second part 4520. In some implementations, the adhesive portion 460 can have a thickness sufficient to fill a space between the door panel 300 and the second part 4520.

Accordingly, when the door panel 300 is made of a glass material, the thickness of the door panel 300 can be greater than that of the door panel 300 made of a metal material. For example, a thickness of the door panel 300 made of the glass material in the front and rear direction can be approximately 5 times greater than the thickness of the door panel 300 made of the metal material. Accordingly, when the door panel 300 made of a metal material is applied, the thickness of the adhesive portion 460 can be greater than when the door panel 300 made of a glass material is applied.

The adhesive portion 460 provided on the second part 4520 can have a length corresponding to a width of the second part 4520 in the left and right direction.

The length of adhesive portion 460 provided on the upper cap decor 430 or the lower cap decor 440 in the vertical direction can be determined as a length corresponding to a width of the second part in the left and right direction.

In some implementations, a buffer member 3010 can be provided on the rear surface of the door panel 300. The buffer member 3010 can be provided between the door panel 300 and the door body 400.

The buffer member 3010 can be bent or change its form from an internal impact when the foam material is filled or the buffer member 3010 can be bent or change its form from an external impact, thereby preventing external deformation of the door panel 300.

The buffer member 3010 can be spaced apart from the end portion of the door panel 300 at a predetermined gap. For example, the buffer member 3010 can be provided in the remaining portion except for a space spaced apart from the rear end portion of the door panel 300 by a predetermined gap.

The buffer member 3010 can be made of polyurethane foam, more specifically, flexible polyurethane foam.

In some implementations, the buffer member 3010 can be spaced apart from the rear end portion of the door panel 300 inward at a predetermined gap and can overlap at least a portion of the adhesive portion 460.

For example, the adhesive portion 460 can be provided on the entire surface of the second part 4520 of the side decor 450, and one end of the buffer member 3010 can be disposed over a portion of the second part 4520. For example, the buffer member 3010 may be disposed to face at least a portion of the second part 4520 such that the buffer member 3010 overlaps with at least a portion of the second part 4520.

The buffer member 3010 can be disposed to overlap some portions of the second part 4520 on which the adhesive portion 460 is disposed but may not be disposed to overlap the entire portion on which the adhesive portion 460 is disposed. In this case, it is possible to effectively block the door panel 300 from being bent due to impact after foaming of the insulation material by the buffer member 3010.

At this time, as illustrated in FIG. 23, before the door panel 300 is mounted on the door body 400, the adhesive portion 460 can be provided on the side decor 450, and the buffer member 3010 can be provided on the door panel 300.

For example, before the door panel 300 is mounted on the door body 400, the adhesive portion 460 has a predetermined thickness and can be provided in parallel with the surface of the second part 4520 of the side decor 450. By way of further example, a thickness of a portion of the bonding portion 460 in contact with the buffer member 3010 can be the same as a thickness of a portion of the bonding portion 460 not in contact with the buffer member 3010. In this case, the thickness refers to the distance of the adhesive portion 460 in the front and rear direction.

In addition, when the door panel 300 is compressed by the door body 400 and the door panel 300 is mounted on the door body 400, as illustrated in FIG. 24, while the adhesive portion 460 is pressed by the buffer member 3010, as illustrated in FIG. 24, the adhesive portion 460 and the buffer member 3010 can be disposed in an overlapping state.

For example, when the buffer member 3010 has a size corresponding to the size of the door panel 300 and the buffer member 3010 is disposed on the entire area of the door panel 300, there is a problem that, although no bending occurs in the door panel 300 by impact after foaming, shaking of the door panel 300 due to the thickness of the buffer member 3010 is generated.

In addition, when the buffer member 3010 is spaced apart from the portion where the adhesive portion 460 is disposed and is disposed inside the door panel 300, there is a problem that bending is generated in the space between the buffer member 3010 and the adhesive portion 460.

Therefore, the buffer member 3010 can be provided such that the buffer member 3010 and the adhesive portion 460 overlap by a predetermined portion.

For example, the ends of the buffer member 3010 in the left and right direction may be located at end portions extending outwardly by about 5 to 20 mm from the inner end of the second part 4520.

In some implementations, the buffer member 3010 is provided such that the portion overlapping the adhesive portion 460 is 10 to 50% of the area of the adhesive portion 460 in the horizontal direction based on the adhesive portion 460 provided in the second part 4520 of the side decor 450. In this case, when the door panel 300 is foamed to form an insulation material, it is possible to effectively block bending and shaking.

Hereinafter, when the door panel is made of a glass material, a coupling structure between the door panel and the door body will be described in detail.

Figure 25:
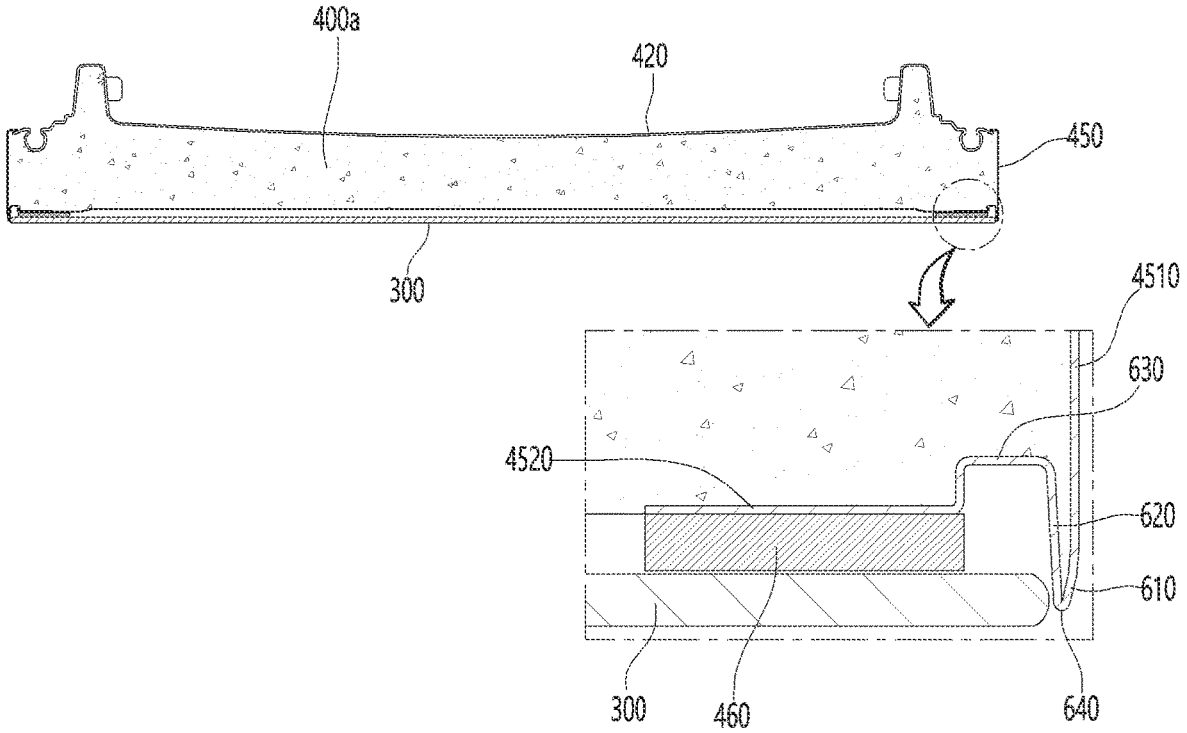
FIG. 25 is a diagram illustrating a cross-sectional view of another example of a coupling structure of a decorative panel and a door body.

FIG. 25 is a diagram illustrating a cross-sectional view of another exemplary coupling structure of a decorative panel and a door body.

A door can include the door panel 300 and the door body 400, but the door panel 300 may be made of a glass material instead of a metal material.

In this case, the door body 400 can further include a body cover providing a front surface. The body cover may be provided to support the rear surface of the door panel 300. In addition, the body cover can be provided to block the inside of the door from being reflected by the door panel 300 made of glass material, but is not limited thereto.

In some implementations, the door panel 300 can be mounted to the door body 400 by the adhesive portion 460 provided on the edge of the door body 400. The adhesive portion 460 can be the same as the adhesive portion 460 provided in the side decor 450 described above.

For example, by the adhesive portion 460, the door panel 300 of the glass material can be mounted on the door body 400, in the same manner that the door panel 300 of the metal material is mounted on the door body 400.

In some implementations, when the door panel 300 of the glass material is mounted on the door body 400, the thickness of the adhesive portion 460, that is, the thickness in the front and rear direction can be provided thinner than when the door panel 300 of the metal material is mounted on the door body 400. This is because the thickness of the door panel 300 of the glass material in the front and rear direction is provided to be thicker than that of the door panel 300 of the metal material.

For example, by reflecting the thickness difference according to the material of the door panel 300 and changing the thickness of the adhesive portion 460 in the front and rear direction, there is an advantage that the door panel 300 can be mounted on the door body 400 irrespective of the material of the door panel 300. There is an advantage that the side decor 450 having the same structure can be used regardless of the type of the door panel 30, by diversifying the thickness of the adhesive portion 460.

In addition, when the door panel 300 of the glass material is applied, the bent portion 3020 may not be formed at the side end portion of the door panel 300.

In addition, when the door panel 300 of the glass material is applied, the deformation due to impact is relatively smaller than that of the door panel 300 of the metal material during foaming to form an insulation material, so that the flow prevention foam 700 or the buffer member 3010 may be omitted.

In some implementations, when the door body 400 and the door panel 300 are fully mounted, the bent portion 600 of the side decor 450 can be in contact with both side ends of the door panel 300. In this case, as the first bent portion 610 and the second bent portion 620 extend in the direction of the door panel 300, a gap between the first bent portion 610 and the second bent portion 620 can become narrower. Accordingly, the process of mounting the door panel 300 to the door body 400 may be easy. In addition, there is an advantage in that the completeness of the outer appearance can be improved by minimizing the gap between the door panel 300 and the door body 400.

The technical idea disclosed as described above is not applied only to the above refrigerator and the door thereof, but may also be applicable to a main body having a cavity, home appliances having a door for opening and dosing the cavity, and the door thereof. For example, the above technical idea may be applied to a cooking appliance having a cooking chamber, a dish washing machine having a washing chamber, a clothes processing apparatus having a clothes processing chamber, a wine cellar having a storage chamber, an air conditioner, and the like.

What is claimed is:

1. A refrigerator comprising:

a door including a door body and a door panel coupled to the door body; and a buffer member disposed at a rear surface of the door panel and provided between the door body and the door panel, wherein the door body defines a first part at a front surface, wherein an adhesive portion is provided at the first part between the door body and the door panel and between the door body and the buffer member to thereby couple a rear surface of the door panel and a rear surface of the buffer member to the front surface of the door body, and wherein the rear surface of the buffer member contacts a first portion of the adhesive portion and the rear surface of the door panel contacts a second portion of the adhesive portion.

2. The refrigerator of claim 1, wherein the door panel and the adhesive portion are configured to, based on the door body being coupled to the door panel, change a form of the buffer member.

3. The refrigerator of claim 1, wherein the buffer member overlaps a portion of the first part and is configured to, based on the door body being coupled to the door panel, block the door panel from being bent.

4. The refrigerator of claim 1, wherein the buffer member is spaced apart from an end portion of the door panel at a predetermined distance.

5. The refrigerator of claim 1, wherein the buffer member overlaps a portion of the first part that is less than a portion of the first part overlaps with the adhesive portion.

6. The refrigerator of claim 5, wherein the adhesive portion overlaps an entire surface of the first part of the door body.

7. The refrigerator of claim 1, wherein the buffer member overlaps with a portion of the adhesive portion to cause the door panel to form an insulation material.

8. The refrigerator of claim 1, wherein the buffer member overlaps with 10 to 50% of the adhesive portion.

9. The refrigerator of claim 1, wherein the door body includes a second part connected to the first part.

10. The refrigerator of claim 9, wherein a distance between the door panel and the second part is greater than a distance between the door panel and the first part.

11. The refrigerator of claim 9, wherein a distance between a front edge of the door body and the second part is greater than a distance between the front edge of the door body and the first part.

12. The refrigerator of claim 9, further comprising:

a foam provided between the door body and the door panel, wherein the door panel provides a bent portion at a first end, the bent portion spaced apart from the second part.

13. The refrigerator of claim 12, wherein the foam is provided between the bent portion and the second part.

14. The refrigerator of claim 12, wherein the bent portion is bent inwardly to thereby contact the foam.

15. The refrigerator of claim 14, wherein an end portion of the bent portion is substantially parallel to the second part.

16. The refrigerator of claim 15, wherein the end portion of the bent portion and the second part are spaced apart at a predetermined distance.

17. A home appliance comprising:

a door including a door body and a door panel coupled to the door body; and a buffer member disposed at a rear surface of the door panel and provided between the door body and the door panel, wherein the door body defines a first part at a front surface, wherein an adhesive portion is provided at the first part between the door body and the door panel and between the door body and the buffer member to thereby couple a rear surface of the door panel and a rear surface of the buffer member to the front surface of the door body, and wherein the rear surface of the buffer member contacts a first portion of the adhesive portion and the rear surface of the door panel contacts a second portion of the adhesive portion.

18. The home appliance of claim 17, wherein the door panel and the adhesive portion are configured to, based on the door body being coupled to the door panel, change a form of the buffer member.

19. The home appliance of claim 17, wherein the buffer member overlaps a portion of the first part and is configured to, based on the door body being coupled to the door panel, block the door panel from being bent.

20. The home appliance of claim 17, wherein the buffer member overlaps a portion of the first part that is less than a portion of the first part overlaps with the adhesive portion, and wherein the adhesive portion overlaps an entire surface of the first part of the door body.

* * * * *